US009359131B2

(12) United States Patent
Ellis

(10) Patent No.: US 9,359,131 B2
(45) Date of Patent: Jun. 7, 2016

(54) FLOATING ROOF TANK HAVING SUPPORT STRUCTURES FOR PROTECTING THE PERIPHERAL SEAL

(71) Applicant: Vertical Tank, Inc., Bakersfield, CA (US)

(72) Inventor: Stanley W Ellis, Bakersfield, CA (US)

(73) Assignee: Vertical Tank, Inc., Bakersfield, CA (US)

( * ) Notice: Subject to any disclaimer, the term of this patent is extended or adjusted under 35 U.S.C. 154(b) by 0 days.

(21) Appl. No.: 14/282,799

(22) Filed: May 20, 2014

(65) Prior Publication Data

US 2015/0001218 A1 Jan. 1, 2015

Related U.S. Application Data

(60) Provisional application No. 61/841,899, filed on Jul. 1, 2013.

(51) Int. Cl.
*B65D 88/40* (2006.01)
*B65D 88/42* (2006.01)

(52) U.S. Cl.
CPC ..... *B65D 88/40* (2013.01); *B65D 88/42* (2013.01)

(58) Field of Classification Search
CPC ..... B65D 88/34; B65D 88/42
USPC ..... 220/216, 217, 220, 221, 222, 218, 219, 220/223, 224, 225, 226; 73/1.33
See application file for complete search history.

(56) References Cited

U.S. PATENT DOCUMENTS

| | | | | |
|---|---|---|---|---|
| 5,305,904 | A * | 4/1994 | Cutts | B65D 88/34 220/216 |
| 2004/0016755 | A1* | 1/2004 | Gilbert et al. | 220/216 |
| 2007/0023432 | A1* | 2/2007 | Seow | B65D 88/34 220/216 |
| 2007/0194057 | A1* | 8/2007 | Gehl | G01F 23/00 222/386 |
| 2012/0091135 | A1* | 4/2012 | Ben Afeef | 220/220 |

* cited by examiner

*Primary Examiner* — Robert J Hicks
*Assistant Examiner* — Kareen Thomas
(74) *Attorney, Agent, or Firm* — Matthew C. McCartney, Esq.; Eastman & McCartney LLP

(57) ABSTRACT

Floating roof tank for a volatile liquid have an outer roof and an internal floating roof with a primary seal with a support such that when the tank is empty, the floating roof will rest on the support whether the tank is in a vertical or horizontal position. The support enables the tank to be transported in a horizontal position without damage to the seal. The floating roof tank with support can be configured as a conical tank, flat bottom tank or slant bottom tank. The floating roof tank can also include a cleaning system and a flush mounted manway cover.

20 Claims, 23 Drawing Sheets

FLOATING ROOF TANK HAVING SUPPORT STRUCTURES FOR PROTECTING THE PERIPHERAL SEAL

RELATED APPLICATIONS

This application claims the benefit of priority to the U.S. Provisional patent application for "FLOATING ROOF TANK HAVING SUPPORT STRUCTURES FOR PROTECTING THE PERIPHERAL SEAL," Ser. No. 61/841,899 filed on Jul. 1, 2013.

FIELD OF THE INVENTION

The present invention relates to floating roof tanks, and a design of floating roof tank which provides structure for protecting the peripheral seal elements attached to a floating roof when the tank is moved from a vertical orientation to positions varying from vertical, which may range from slightly off vertical up to and including a horizontal position. The present invention provides lateral support structures which prevent the crushing of the peripheral seal element between the adjacent outside edge of the floating roof and the inside wall of the tank These lateral support structures allow a floating roof tank to be placed into a horizontal orientation without causing damage to the peripheral seal elements, thereby allowing a floating roof tank to be placed on a trailer, flatbed or wheel assembly for transporting in a horizontal orientation.

BACKGROUND OF THE INVENTION

Floating roof tanks are widely used for storing volatile petroleum-based liquids. The floating roof of this type of tank has a built-in buoyancy which allows it to float on top of the liquid product contained in the tank. Floating roof tanks may be configured either as internal floating-roof tanks or as external floating-roof tanks. In each configuration, the floating roof is designed to remain in contact with the liquid surface of the product and to cover all of the surface of the product except for a small annular surface area between the outermost rim of the floating roof and the inside surface of the tank shell. In other words, the overall diameter of the roof has a diameter which is smaller than the inside diameter of the tank, leaving a gap between the circumferential edge of the roof and the inside diameter of the tank. To prevent the release of volatilized product from the tank as well as preventing rain water from entering the tank, this gap is closed or sealed by a flexible sealing system, which retains the seal as the roof is raised and lowered by the level of the product within the tank.

The primary objectives of the prior art typically address improving the sealing arrangement for floating roof tanks, as acknowledged in U.S. Pat. No. 4,308,968 by Thiltgen, et al. The '968 patent discloses the benefits of having a secondary seal which is highly flexible and capable of conforming to changing shapes and sizes of the surrounding walls and parts and which also protects the vapor-impermeable portions of the seal against rapid wear and deterioration.

The environmental benefits of floating roof tanks are widely disclosed, and regulations which severely restrict the release of volatile organic compounds into the atmosphere are ubiquitous. For permanent facilities, the known floating roof tanks provide a good solution for containing the release of these volatile emissions. However, heretofore, the control of volatile emissions from temporary storage facilities, such as temporary test tanks, has been problematic, often requiring extensive vapor recovery systems capable of handling the large volumes of the volatile emissions. One means of mitigating this problem would be a transportable floating roof tank. However, floating roof tanks are generally designed for large permanent facilities. The issue is not of size, because a smaller tank can always be fabricated to facilitate transportation, but rather whether the tank will withstand the various dynamic loads to which it will be subjected in the course of being transported and placed. There is the issue of the structural integrity of the tank itself, and there is also the issue of protecting the integrity of the primary and secondary seals between the floating roof and the inner wall of the tank.

In order for a tank to be portable, the tank must have a structural integrity which will withstand the various forces to which the tank will be subjected during the course of lifting and transporting. Recently, portable vertical tanks which are capable of withstanding the dynamic loads the tank experiences in the course of transportation and placement have been developed. However, when such tanks are equipped with a floating roof, protecting the integrity of the seals for transportation of the portable vertical tank is not known in the art. Any seal elements between the floating roof and the inner tank wall will be subjected to the weight of the floating roof and connected structures if the position of the tank is changed from a general vertical operating position to a horizontal position for transportation and/or storage. Thus, changing the position of a floating roof tank to a horizontal orientation as generally required for transportation will result in the crushing of the seals causing damage the integrity of the seals.

SUMMARY OF THE INVENTION

The present invention provides a system for protecting the seals of a floating roof tank, including the providing of protection when the position of the tank is shifted from a generally vertical operational position to a generally horizontal position for storage and transportation.

The present invention includes a floating roof that is located within a vertical tank such that when the tank is empty, the floating roof will rest on a support such that the floating roof will be supported by the support whether in a vertical or horizontal position. The floating roof tank has a tank top, bottom and side walls together forming an interior space capable of holding various liquids used in oil and gas production operations, including drilling mud. The floating roof is made up of a top, bottom and side wall making up an interior air space and capable of floating on top of the liquid located within the interior space of the tank. As the level of the liquid within the tank drops, the floating roof lowers within the tank. Similarly, when liquid is added within the interior of the tank, the floating roof rises within the tank.

The floating roof tank is equipped with a seal system known in the art. In a preferred embodiment, the floating roof has a primary seal and a secondary seal, each of which is mounted to the side of the floating roof such that as the floating roof rises and falls, the seals prevent vapors from the liquid from passing between the side wall of the floating roof and the side wall of the floating roof tank. These seals ensure that no vapors form in the vapor free area of the tank.

The floating roof tank is also equipped with a support mounted to either the top or the bottom of the tank. The support is sized to fit within a recessed area of the floating roof tank such that the floating roof can rest on the support in both a vertical configuration and a horizontal configuration.

A guide is connected to the floating roof such that when the floating roof is resting on the support, the guide can be locked at the top of the tank such that the floating roof is held in place against the support. When the tank is moved from a horizontal position to a vertical position for transport, the weight of the floating roof is supported by the support rather than the seals. Thus, the integrity of the seals will be maintained when the tank is in a horizontal position and transported from one location to another location.

In another embodiment of the invention, the tank is equipped with a cleaning system including an annular cleaning pipe mounted to the base of the tank that includes a plurality of spray outlets that face the bottom of the floating roof. When a cleaning liquid is passed through the annular cleaning pipe, the cleaning liquid is sprayed onto the bottom of the floating roof through the spray outlets.

In an embodiment of the invention, the tank is equipped with a flush fit manway cover such that the interior of the manway cover is flush with the inner wall of the sidewall of the tank so as to preserve the seal as the floating roof passes over the interior surface of the manway cover.

The manway allows for access to the interior of the tank for maintenance of the floating roof and to facilitate cleaning of the tank. It is to be appreciated that the floating roof can be made up of component parts such that the floating roof can be disassembled and removed through the manway opening.

Thus, when the floating roof tank is moved from a vertical position to a horizontal position for transport, the weight of the floating roof will be supported by the supporting base rather than the more fragile seals. To prepare the tank for transport, the liquid is drained from the tank so as to allow the floating roof to rest on the support. The present invention contemplates various configurations of supports and corresponding geometries of floating roofs that can be used with common vertical tank configurations, including but not limited to flat bottom tanks, slant bottom tanks and conical bottom tanks.

In another embodiment of the invention, the support can be mounted to the underside of the outer roof the tank. The floating roof can be equipped with cable, which passes through the outer roof to a winch system. When the floating roof tank is completely drained and the floating roof is resting on the floor, the floating roof can be raised by the winch until it rests securely on the support. The winch system can then be locked to ensure that the floating roof is secured on the support. Once so secured, the tank can be lowered form a vertical position to a horizontal position for transport such that the weight of the floating roof is supported by the support rather than the seals.

The floating roof tank can be fitted with a cleaning system to facilitate the cleaning of the tank when the floating roof is resting on the support and in the locked position. The cleaning system consists of half pipe mounted to the tank floor and connected to an inlet pipe that passes through the tank side wall. The half pipe can be in any geometry so long as it does not interfere with the support base. The half pipe includes a plurality of water spray outlets opposite the tank floor such that when a cleaning solution is passed through the half pipe, the cleaning solution exits the water spray outlets and cleans the underside of the floating roof of any remaining debris that could cause volatile vapor formation. The cleaning solution and any remaining particulates then pass out through a drain at the floor of the tank.

In another embodiment of the invention, a locking member is removably attached to secure the lateral position of the floating roof member with respect to internal guides disposed within the tank. The floating roof member may comprise integral sleeves which may land into or onto internal landing members within the tank and be locked to the internal landing members by various locking means including pins, clamps, interference fit, or other fastening devices and/or methods.

Multiple floating roof tanks of the present invention may be utilized collectively to provide greater storage capacity. In this embodiment, a first connecting member has a first end and a second end. The first end of the first connecting member is attached to a first floating roof tank and the second end of the first connecting member includes a first fastener. A second connecting member has first and second ends. The first end of the second connecting member is attached to a second floating roof tank and the second end of the second connecting member includes a second fastener. The first and second fasteners are connectable.

In another embodiment of the invention, the floating roof member may be secured in a lateral position with respect to the internal walls of the tank by one or more cables which are removably attached to the floating roof member for purposes of movement and transportation. This embodiment may further comprise a horizontal structure for supporting the tank for transporting the tank as required, which may comprise a component of a trailer or transportable skid unit.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
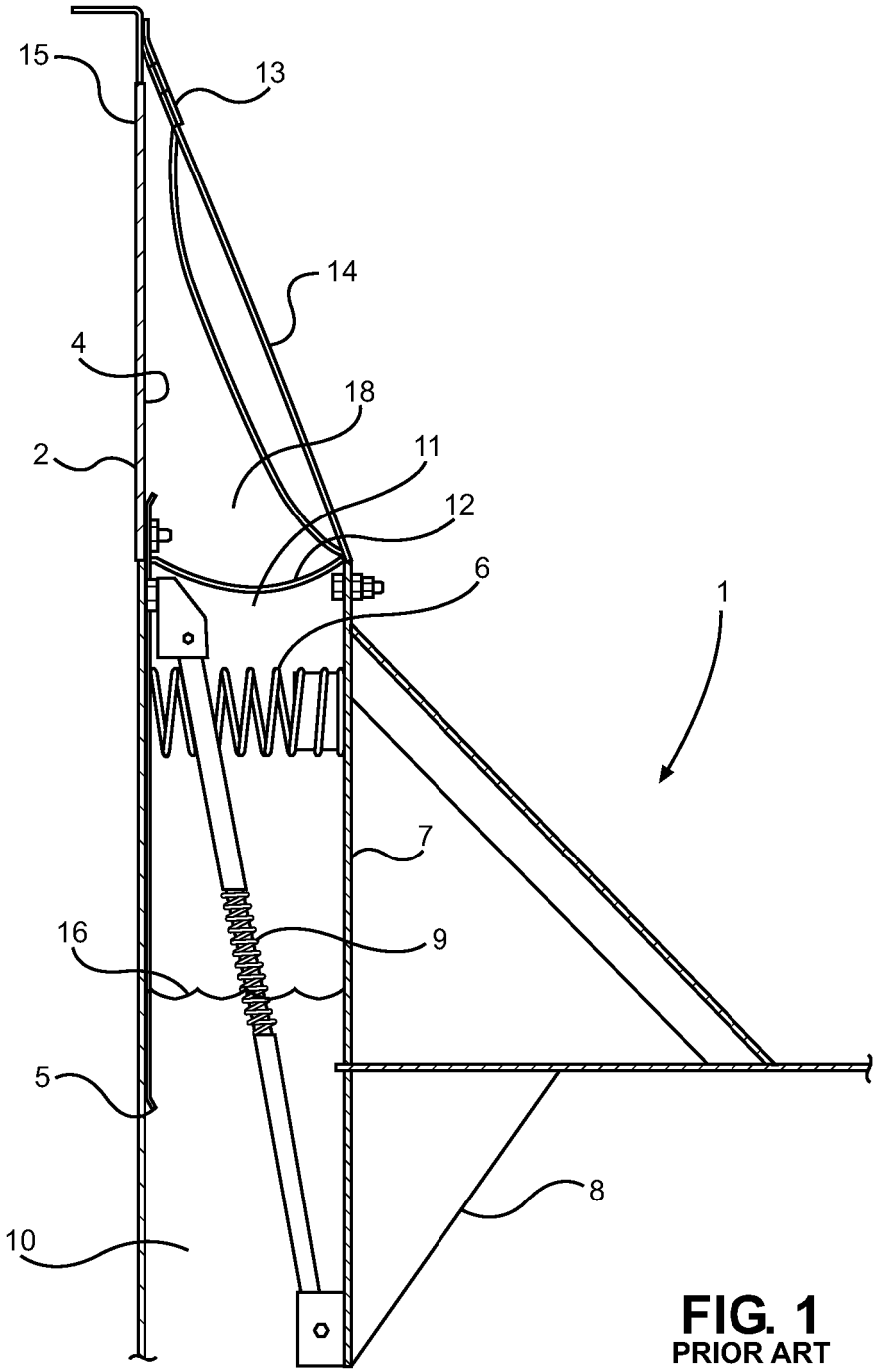
FIG. 1 PRIOR ART
FIG. 1 is a detailed view of a cross-section of one example of an existing floating roof tank showing common components found with such devices.

FIG. 1 shows a generalized form of a prior art floating roof tank, disclosed in U.S. Pat. No. 5,515,989 by Petrie, et al., in which a floating roof 1 floats atop the liquid 10. A shoe 5 slides along the inner wall 4 of tank 2. The shoe 5 is pushed against the inner wall 4 by a pusher spring 6 which is mounted against the outer rim plate 7. Brace 8 helps support the shoe support 9. The shoe support 9 also pushes shoe 5 against inner wall 4. The volatile liquid 10 evaporates vapors 11 which are trapped by a primary seal comprising a shoe 5 and a primary vapor barrier 12. Primary vapors 11 create a saturated vapor space. Primary vapor barrier 12 is mounted between shoe 5 and outer rim plate 7. A compression plate 14 supports a secondary seal 13 against the inner wall 4. This arrangement seals in the secondary vapors 18.

Figure 2:
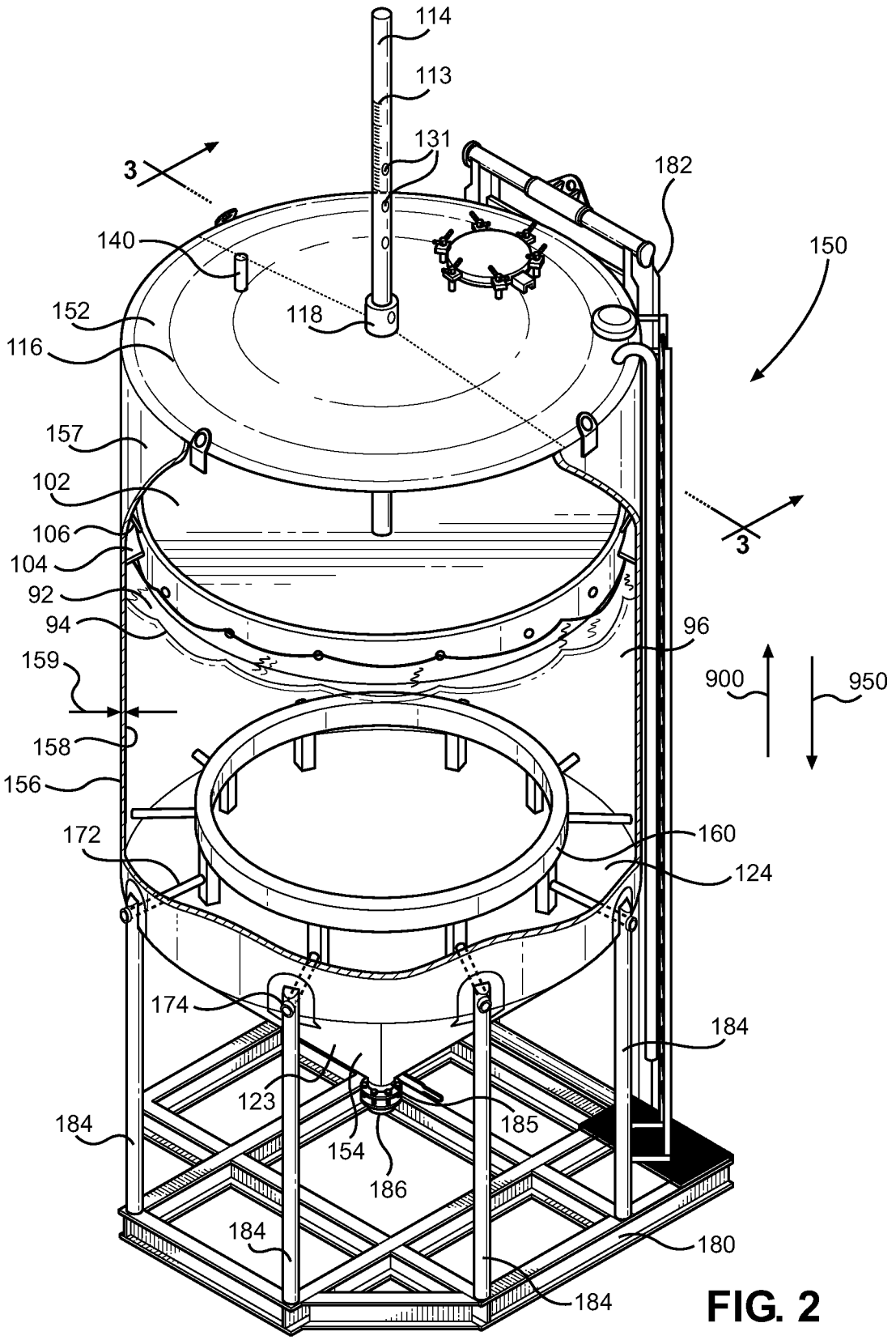
FIG. 2 is a partially cutaway isometric view of a conical floating roof tank showing a conical floating roof and a support base ring wherein the conical floating roof is partially filled with a liquid and the floating roof is floating on the liquid.

Referring to FIG. 2, a partially cutaway isometric view of a conical floating roof tank 150 with a floating roof 102 is shown. As shown in FIG. 2, the tank 150 has an outer roof 116, a bottom 154, a tank wall 156 and a drain 185. The outer roof 116, bottom 154 and tank wall 156 form a tank interior space 96 capable of holding liquid 92. Liquid 92 can be added to or removed from the tank interior space 96 by the drain 185. The tank wall 156 has an outer wall 157 and an inner wall 158. The outer roof 116 has an outer roof exterior surface 121 and an outer roof interior surface 122. The bottom 154 has an exterior surface 123 and an interior surface 124. The tank wall 156, the outer roof 116 and the bottom 154 each has a thickness 159.

Figure 3:
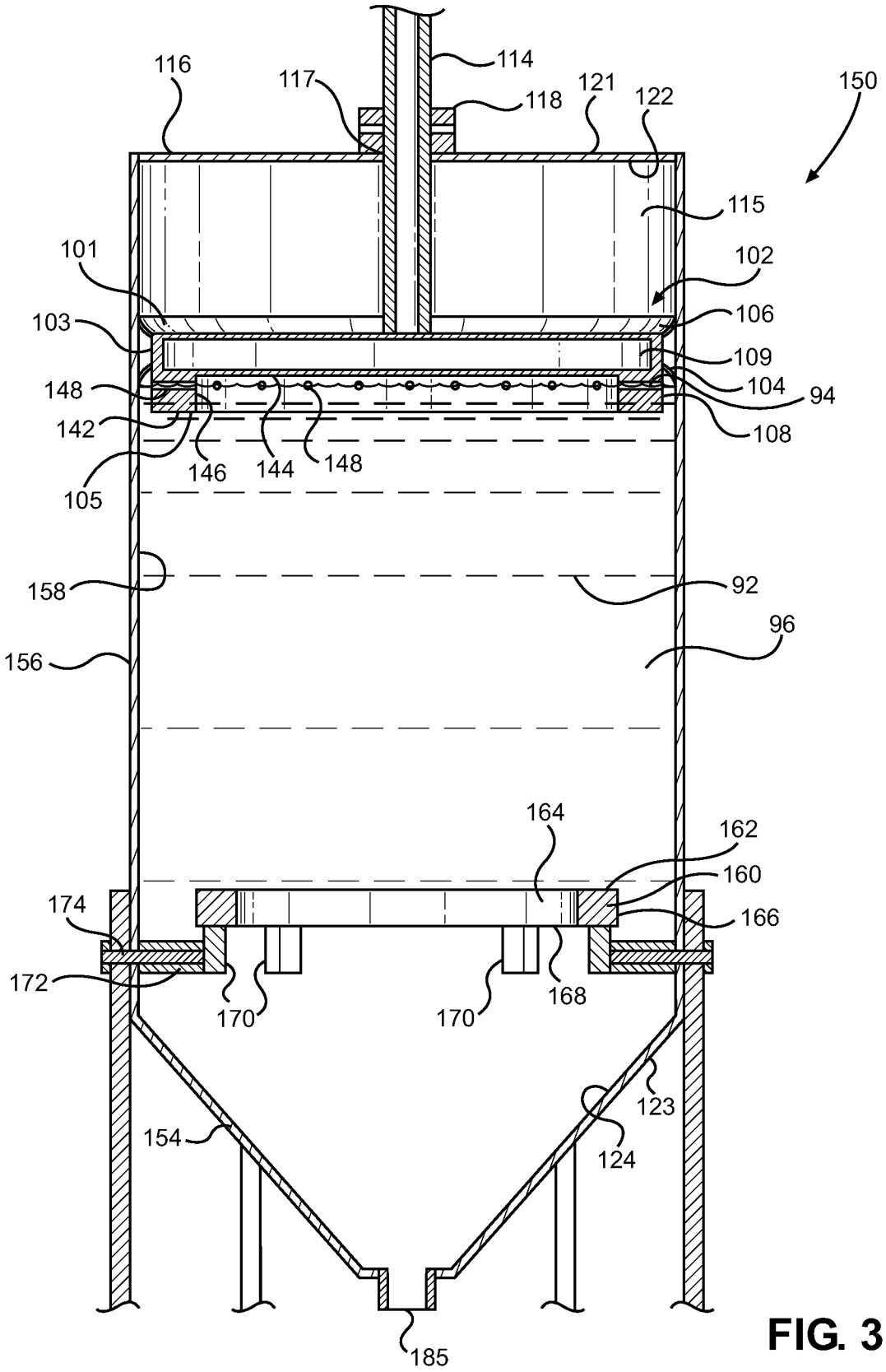
FIG. 3 is a cross-sectional view along the lines 3-3 as shown in FIG. 2, of a conical floating roof tank with a support base ring showing the floating roof floating on a liquid.

The conical floating roof tank 150 is shown with a base frame 180 and a sled frame 182 to add structural rigidity to the tank 150. The sled frame 182 is mounted to the base frame 180 and is also mounted to the outer wall 157 of the tank wall 156. The tank wall 156 also has a plurality of leg supports 184 that are also connected to the base frame 180. The leg supports 184 ensure that the bottom 154 of the conical tank 150 is held above the base frame 180 sufficiently to enable a variety of plumbing fixtures to be attached to the bottom of the tank 150. A valve 186 is shown connected to a drain 185 at the bottom 154 of the conical tank 150. As can be seen in FIG. 3, the floating roof 102 has a top 101 and side 103 and a bottom 105. A primary seal 104 is connected to the side 103 of the floating roof 102. The primary seal 104 is in contact with the inner wall 158 of the tank wall 156 sufficiently to prevent vapors from the liquid 92 passing between the side 103 of the floating roof and the inner wall 158 of the tank wall 156, yet maintain the ability to slide along the inner wall 158. A secondary seal 106 is also attached to the side 103 of the floating roof 102 and is also in contact with the inner wall 158. The primary and secondary seals 104 and 106 work in combination to ensure that no vapors created by liquid 92 pass into the vapor free area 115. It is to be understood that any number of sealing systems known in the art can be utilized in combination with the present invention.

Returning back to FIG. 2, an upper guide 114 is mounted to the top of the floating roof 102 and is slidably passed through a hole 117 in the outer roof 116 and a guide collar 118 mounted on the outer roof 116 of the tank 150. The upper guide 114 ensures that the floating roof 102 stays centered with respect to the inner wall 158 of the tank. In FIG. 2, the upper guide 114 and guide collar 118 are depicted as cylindrical. The upper guide 114 can be equipped with a depth indicator 113 such that the liquid level 94 can be determined by reading the depth indicator 113.

The floating roof 102 is shown floating on liquid 92 at liquid level 94. As liquid 92 is added to the tank 150, the liquid level 94 increases causing the floating roof 102 and associated upper guide 114 to move in an upward direction 900. As liquid 92 is removed from the tank 150, the liquid level 94 decreases causing the floating roof 102 and associated upper guide 114 to move in a downward direction 950. The conical floating roof tank 150 depicted in FIG. 2 shows a base ring support 160 mounted near the bottom 154 of the tank 150. As the liquid level 94 falls below the support base ring 160, the floating roof 102 will rest on the support base ring 160. A roof vent 140 is mounted on the outer roof 116 to prevent the formation of vacuum or pressure as the floating roof is raised and lowered.

Turning to FIG. 3, a cross-sectional view along the lines 1-1 of FIG. 1 of a conical floating roof tank 150 with a floating roof 102 and a support base ring 160, is generally shown and described. The floating roof 102 has a floating roof air chamber 109 that increases the buoyancy of the floating roof 102 such that the floating roof 102 will float on liquid 92 in the tank 150.

The support base ring 160 has a top 162, an inner surface 164 and outer surface 166 and a bottom 168. The bottom 168 of support base ring 160 is mounted to base ring supports 170. The base ring supports 170 are connected to the tank by base ring bolts 174, each of which passes through the tank wall 156 an into a base ring support 170. For added stability, base ring support collars 172 can be located between the inner wall 158 and the support base ring 170.

The floating roof 102 has a support receiver such as an extended area 142 and a recessed area 144. The extended area 142 has a contact support surface 146 sized so as to ensure that the contact support surface 146 will rest against the outer surface 166 of the base ring 160 when the tank 150 is moved from a vertical position to a horizontal position. The floating roof 102 has a plurality of equalization passageways 148 that allow liquid 92 to pass from the recessed area 144 of the floating roof out through the side 103 of the floating roof 102 such that the fluid level 94 remains the same in the recessed area 144 as the area between the inner wall 158 of the tank 150 and the side 103 of the floating roof 102. The equalization passageways 148 ensure that no volatile gas builds up in the recessed area 144.

Figure 4:
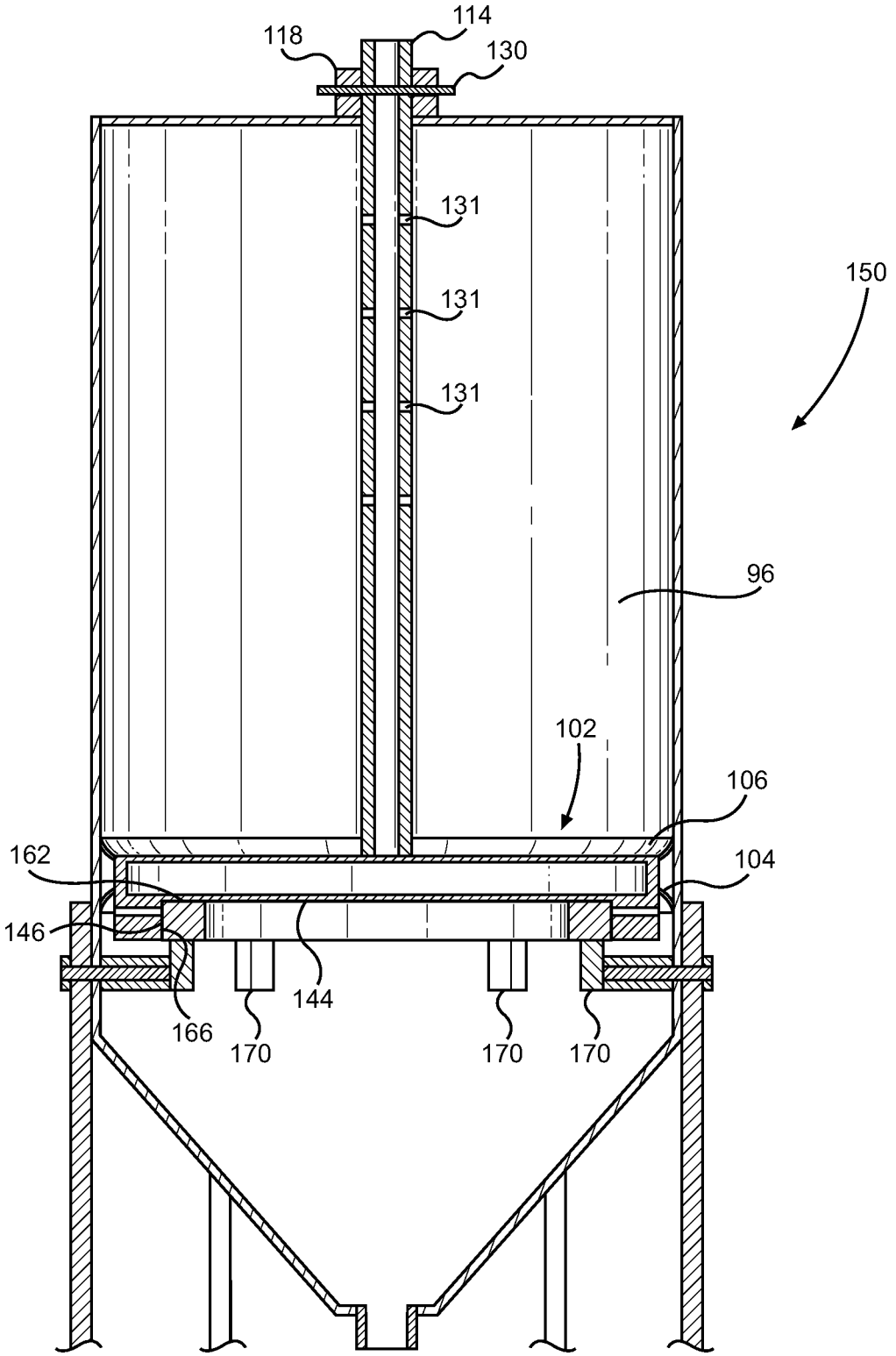
FIG. 4 is a cross-section view of the conical floating roof tank of FIGS. 2 and 3 drained of liquid showing the floating roof in a down position, securely resting on a support base ring and locked in place by a pin passed through a guide on top of the outer roof of the tank.

As can be seen in FIG. 4, the tank 150 has been drained of all liquid 92 such that the recessed area 144 of the floating roof 102 is resting on the base ring top 162 and the contact support surface 146 is located immediately adjacent to the outer surface 166 of the base ring 160. A pin 130 is slidably inserted through upper guide collar 118 and through a pin hole 131 in the upper guide 114 so as to lock the floating roof 102 to the base ring 160. Once so locked, the floating roof tank 150 is ready to be moved from a vertical position to a horizontal position for transport. As the tank 150 is moved from the vertical position to the horizontal position, the weight of the floating roof 102 will be transferred from the contact support surface 146 to the base ring outer surface 166. With the weight of the floating roof 102 being supported by the base ring outer surface 166, the weight of the floating roof 102 will not act on the primary seal 104 or the secondary seal 106, thus preserving the structural integrity of the seals 104 and 106 so that the tank may be transported in a horizontal position.

Figure 5:
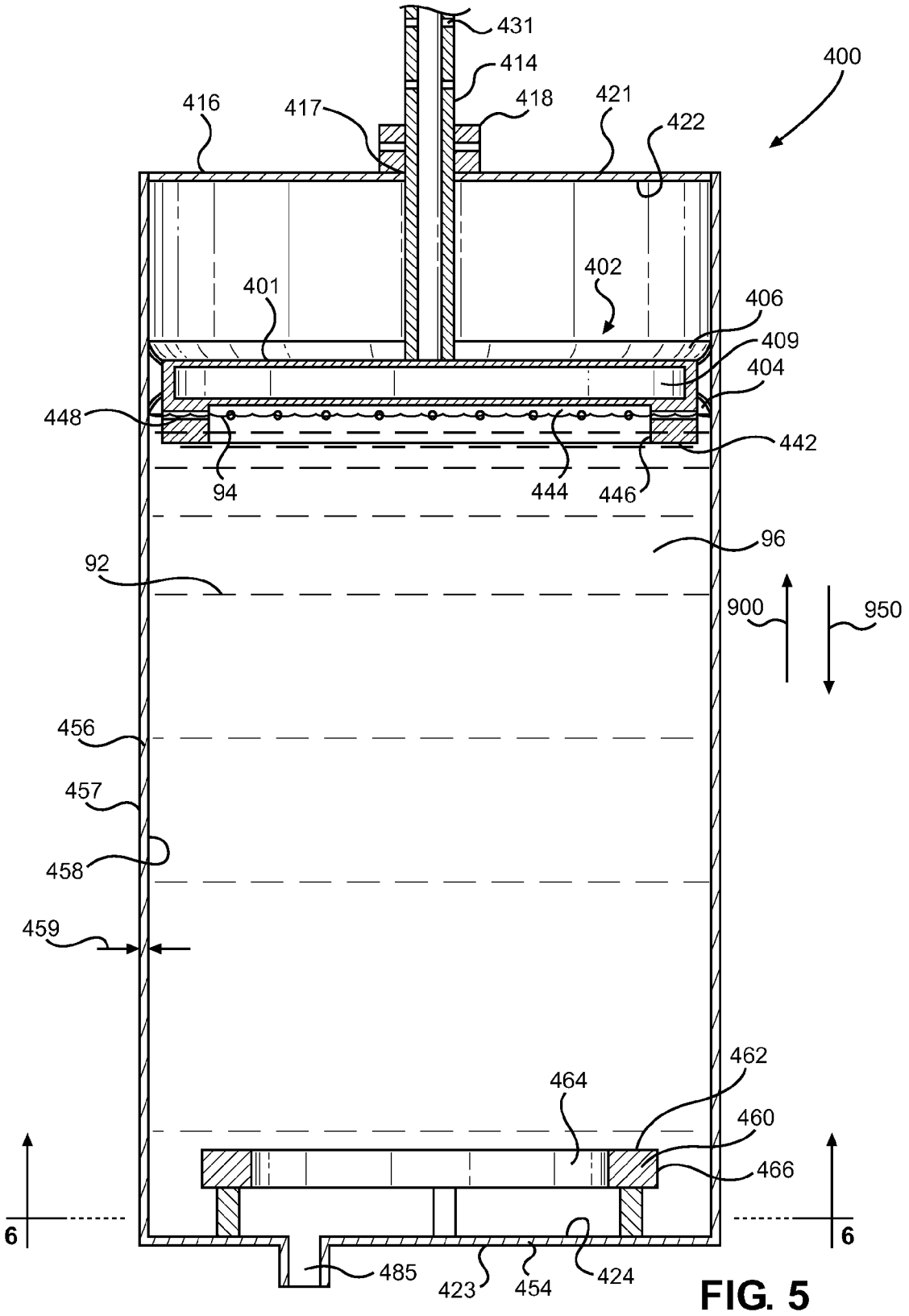
FIG. 5 is a cross-section view of a flat bottom tank of the present invention with a support base ring showing the floating roof floating on a liquid with the liquid passing through several equalizing passageways formed in the floating roof.

FIG. 5 is a cross-section view of an alternative embodiment flat bottom floating roof tank 400 with a support base ring 460 showing the floating roof 402 floating on a liquid 92. The tank 400 has an outer roof 416, a bottom 454, a tank wall 456 and a drain 485. The outer roof 416, bottom 445 and tank wall 456 form a tank interior space 96 capable of holding liquid 92. Liquid 92 can be added to or removed from the tank interior space 96 by the drain 485. The tank wall 456 has an outer wall 457 and an inner wall 458. The outer roof 416 has an outer roof exterior surface 421 and an outer roof interior surface 422. The bottom 454 has an exterior surface 423 and an interior surface 424. The tank wall 456, the outer roof 416 and the bottom 454 each has a thickness 459.

As can be seen in FIG. 5, the floating roof 402 has a top 401 and side 403. The floating roof 402 also has a bottom 405. A primary seal 404 is connected to the side 403 of the floating roof 402. The primary seal 404 is in contact with the inner wall 458 of the tank wall 456 sufficiently to prevent vapors from the liquid 92 passing between the side 403 of the floating roof 402 and the inner wall 458 of the tank wall 456, yet maintain the ability to slide along the inner wall 458. A secondary seal 406 is also attached to the side 403 of the floating roof 402 and is also in contact with the inner wall 458.

An upper guide 414 is mounted to the top of the floating roof 402 and is slidably passed through a hole 417 in the outer roof 416 and a guide collar 418 mounted on the outer roof 416 of the tank 400. The upper guide 414 ensures that the floating roof 402 stays centered with respect to the inner wall 458 of the tank. In FIG. 5, the upper guide 414 and guide collar 418 are depicted as cylindrical.

The floating roof 402 is shown floating on liquid 92 at liquid level 94. As liquid 92 is added to the tank 400, the liquid level 94 increases causing the floating roof 402 to move in an upward direction 900. As liquid 92 is removed from the tank 400, the liquid level 94 decreases causing the floating roof 402 to move in a downward direction 950. The flat bottom floating roof tank 400 has a support base ring 460 mounted near the bottom 454 of the tank 400. As the liquid level 94 falls below the support base ring 460, the floating roof 402 will rest on the support base ring 460.

The floating roof 402 has a floating roof air chamber 409 that increases the buoyancy of the floating roof 402 such that the floating roof 402 will float on liquid 92 in the tank 400.

The support base ring 460 has a top 462, an inner surface 464 and outer surface 466 and a bottom 468. The bottom 468 of support base ring 460 is mounted to base ring supports 470. The base ring supports 470 are connected to the tank bottom 454.

The floating roof 402 has an extended area 442 and a recessed area 444. The extended area 442 has a contact support surface 446 sized so as to ensure that the contact support surface 446 will rest against the outer surface 466 of the base ring 460 when the tank 400 is moved from a vertical position to a horizontal position. The floating roof 402 has a plurality of equalization passageways 448 that allow liquid 92 to pass from the recessed area 444 of the floating roof out through the side 403 of the floating roof 402 such that the fluid level 94 remains the same in the recessed area 444 as the area between the inner wall 458 of the tank 400 and the side 403 of the floating roof 402. The equalization passageways 448 ensure that no volatile gas builds up in the recessed area 444.

Figure 6:
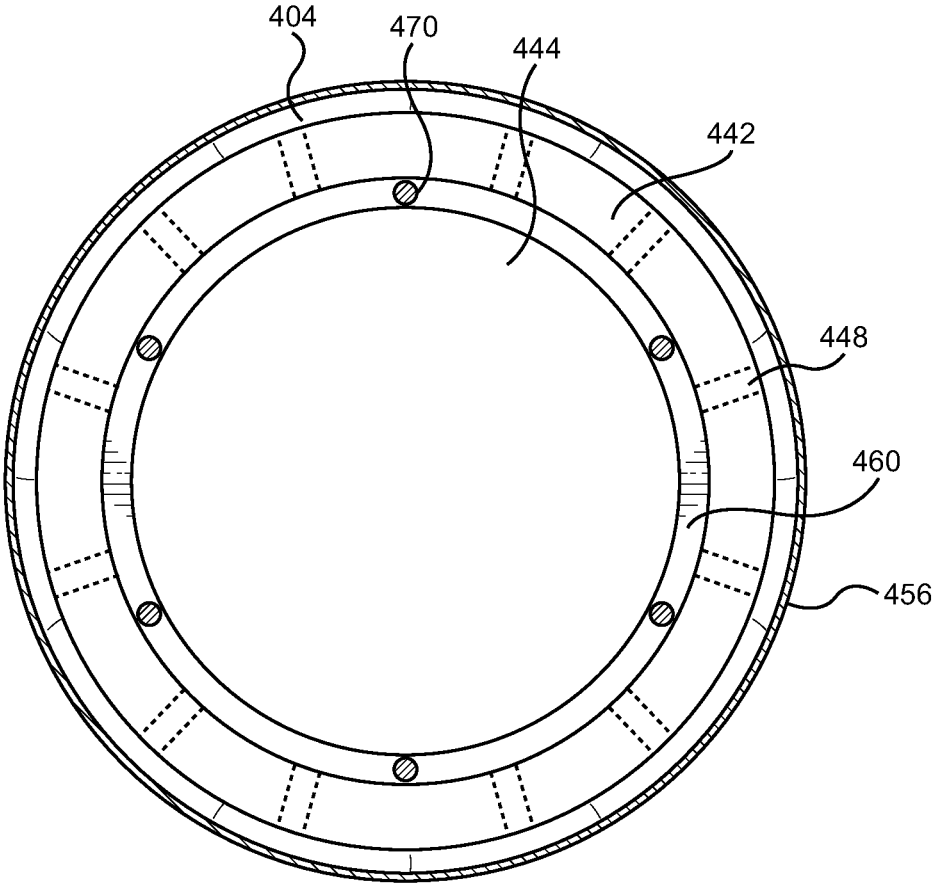
FIG. 6 is a bottom view of the support base ring and floating roof of the flat bottom tank of FIG. 5 along the lines 6-6 as shown in FIG. 5 showing the primary seal, the floating roof extended area, the floating roof recessed area and the underside of the support base ring.

FIG. 6 is a bottom cross sectional view of the support base ring 460 and floating roof 402 of the flat bottom tank 400 taken along the lines 6-6 of FIG. 5. The base ring supports 470 ensure that the support base ring 460 is sufficiently clear of the bottom 454 of the tank 400 to ensure that as liquid 92 is drained from the tank, it can pass between the base ring bottom 468 and bottom 454.

Figure 7:
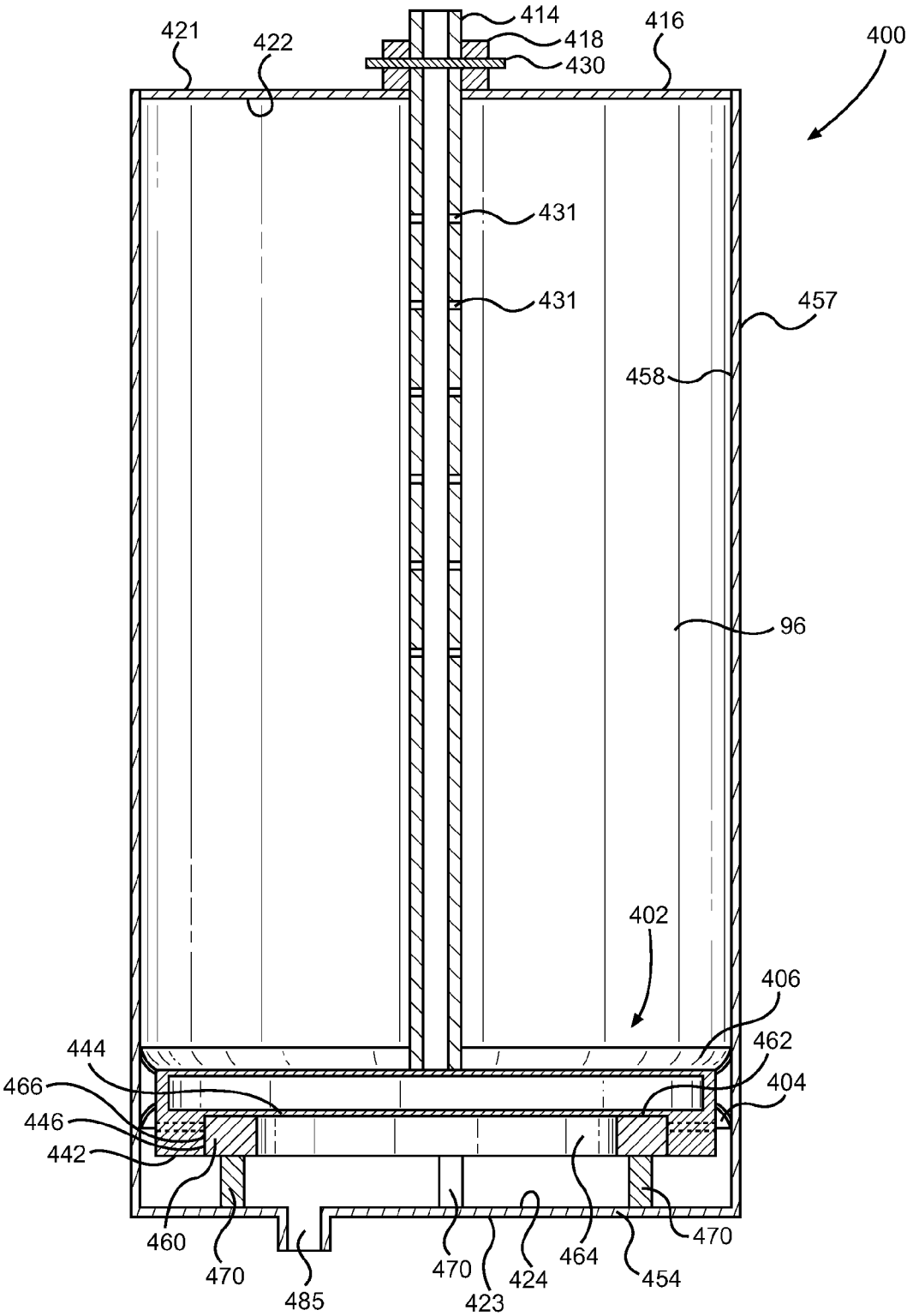
FIG. 7 is a cross-section view of the flat bottom tank shown in FIGS. 5 and 6 with a support base ring, and drained of liquid showing the floating roof resting on the support base ring and locked in place by a pin passed through guide on top of the outer roof of the tank.

As can be seen in FIG. 7, liquid 92 is shown drained from the tank 400 such that the recessed area 444 of the floating roof 402 is resting on the base ring top 462 and the contact support surface 446 is located immediately adjacent to the outer surface 466 of the base ring 460. A pin 430 is slidably inserted through upper guide collar 418 and through a pin hole 431 in the upper guide 414 so as to lock the floating roof 402 to the base ring 460. Once so locked, the floating roof tank 400 is ready to be moved from a vertical position to a horizontal position for transport. As the tank 400 is moved from the vertical position to the horizontal position, the weight of the floating roof 402 will be transferred from the contact support surface 446 to the base ring outer surface 466. With the weight of the floating roof 402 being supported by the base ring outer surface 466, the weight of the floating roof 402 will not act on the primary seal 404 or the secondary seal 406, thus preserving the structural integrity of the seals 404 and 406 so that the tank may be transported in a horizontal position.

Figure 8:
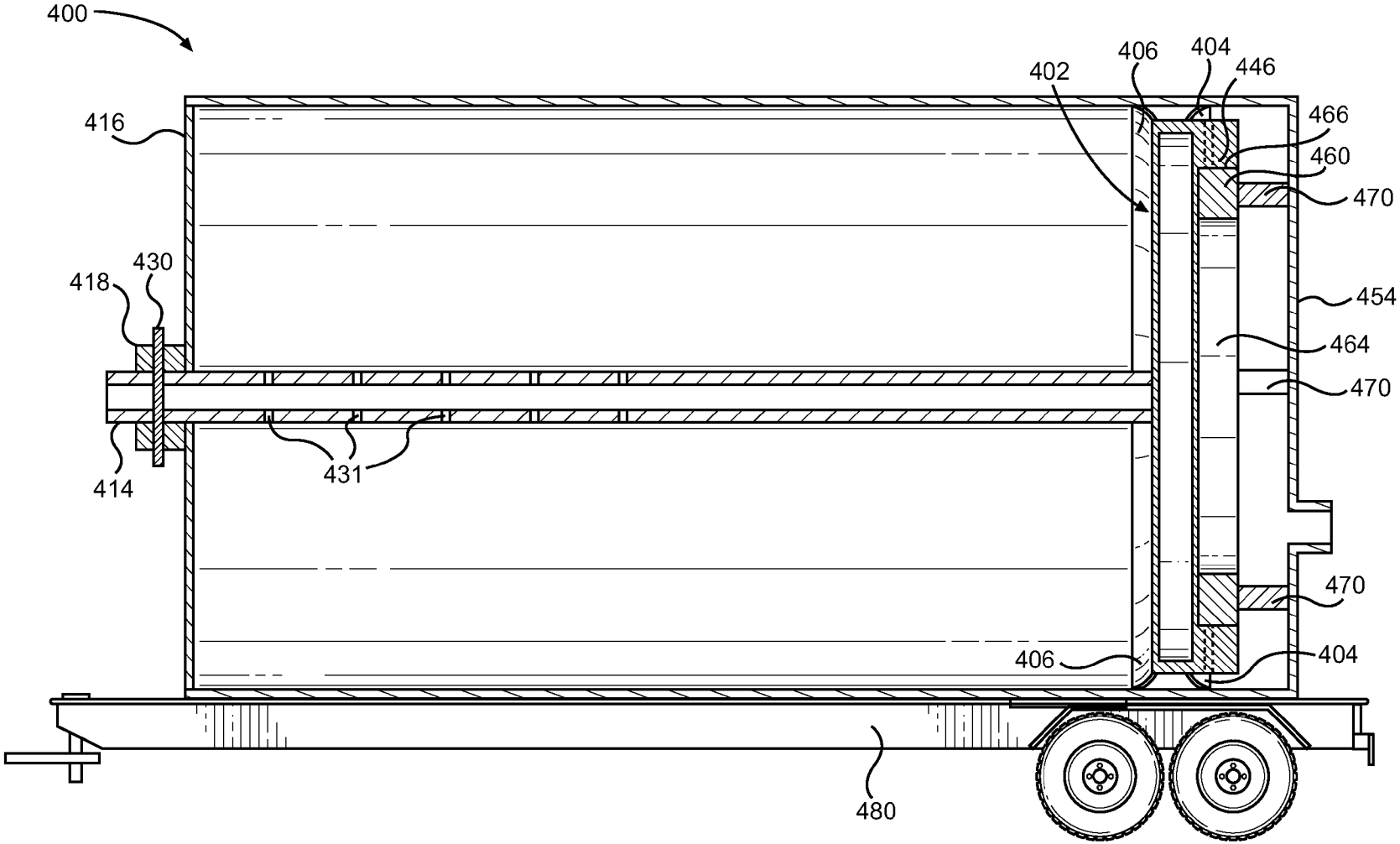
FIG. 8 is a cross-sectional view of a flat bottom tank stored horizontally on a trailer such that the floating roof is supported by the support base ring and locked in place by a pin passed through guide on top of the outer roof of the tank to ensure that the weight of the floating roof rests on the support base ring instead of the primary and secondary seals.

FIG. 8 is a cross-sectional view of a flat bottom tank 400 stored horizontally on a trailer 480 such that the floating roof 402 is supported by the support base ring 460 and locked in place by a pin 430 passed through the upper guide 114 and upper guide collar 418 on top of the outer roof 416 of the tank 400 to ensure that the weight of the floating roof 402 rests on the support base ring 460 instead of the primary 404 and secondary seals 406.

Figure 9:
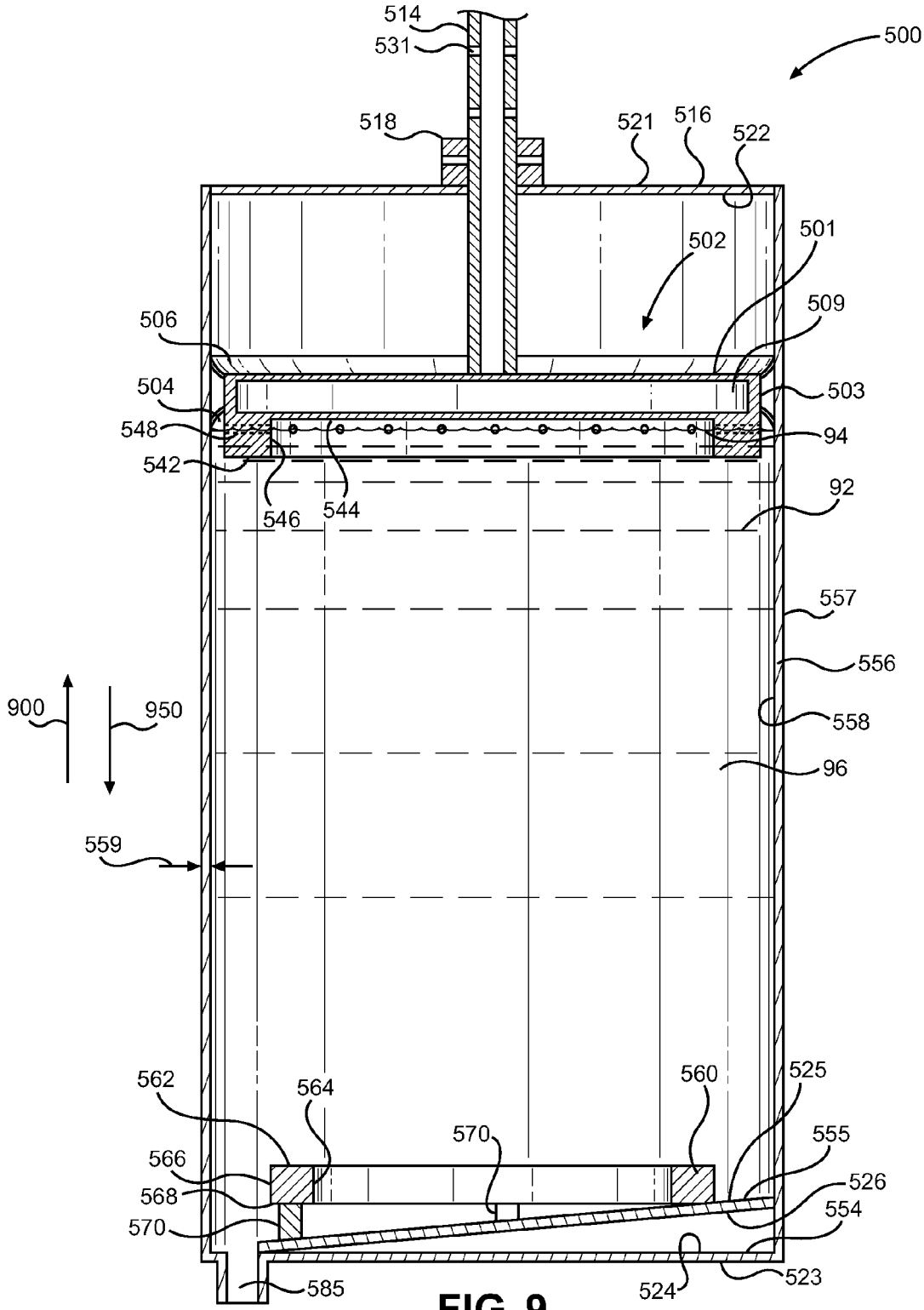
FIG. 9 is a cross-sectional view of a slant bottom floating roof tank of the present invention with a support base ring showing the floating roof floating on liquid with the liquid passing through the equalizing passageways found in the floating roof.

FIG. 9 is a cross-sectional view of a slant bottom floating roof tank 500 with a support base ring 560 showing a floating roof 502 floating on a liquid 92. The tank 500 has an outer roof 516, a bottom 554, a slant bottom 555, a tank wall 556 and a drain 585. The outer roof 516, bottom 545, slant bottom 555 and tank wall 556 form a tank interior space 96 capable of holding liquid 92. Liquid 92 can be added to or removed from the tank interior space 96 by the drain 585. The tank wall 556 has an outer wall surface 557 and an inner wall 558. The outer roof 516 has an outer roof exterior surface 521 and an outer roof interior surface 522. The bottom 554 has an exterior surface 523 and a void surface 524. The slant bottom 555 has an interior surface 525 and a void surface 526. The tank wall 556, the outer roof 516, the bottom 554 and the slant bottom 555 each has a thickness 559. The slant bottom 555 is mounted to the bottom 554 such that the slant bottom 555 can direct liquid towards the drain 585.

As can be seen in FIG. 9, the floating roof 502 has a top 501 and a side 503. The floating roof 502 also has a bottom 505. A primary seal 504 is connected to the side 503 of the floating roof 502. The primary seal 504 is in contact with the inner wall 558 of the tank wall 556 sufficiently to prevent vapors from the liquid 92 passing between the side 503 of the floating roof 502 and the inner wall 558 of the tank wall 556, yet maintain the ability to slide along the inner wall 558. A secondary seal 506 is also attached to the side 503 of the floating roof 502 and is also in contact with the inner wall 558.

An upper guide 514 is mounted to the top of the floating roof 502 and is slidably passed through a guide collar 518 mounted on the outer roof 516 of the tank 500. The upper guide 514 ensures that the floating roof 502 stays centered with respect to the inner wall 558 of the tank. The upper guide 514 can be equipped with a depth indicator 113 as seen in FIG. 2, such that the liquid level 94 can be determined by reading the depth indicator 113.

The floating roof 502 is shown floating on liquid 92 at liquid level 94. As liquid 92 is added to the tank 500, the liquid level 94 increases causing the floating roof 502 to move in an upward direction 900. As liquid 92 is removed from the tank 500, the liquid level 94 decreases causing the floating roof 502 to move in a downward direction 950. As the liquid level 94 falls below the support base ring 560, the floating roof 402 will rest on the support base ring 560.

The floating roof 502 has a floating roof air chamber 509 that increases the buoyancy of the floating roof 502 such that the floating roof 502 will float on liquid 92 in the tank 500.

The support base ring 560 has a top 562, an inner surface 564 and outer surface 566 and a bottom 568. The bottom 568 of support base ring 560 is mounted to base ring supports 570. The base ring supports 570 are connected to the slant bottom 555. The base ring supports 570 are of varying height in order to ensure that the support base ring 560 is level with floating roof 502.

The floating roof 502 has an extended area 542 and a recessed area 544. The extended area 542 has a contact support surface 546 sized so as to ensure that the contact support surface 546 will rest against the outer surface 566 of the base ring 560 when the tank 500 is moved from a vertical position to a horizontal position. The floating roof 502 has a plurality of equalization passageways 548 that allow liquid 92 to pass from the recessed area 544 of the floating roof out through the side 503 of the floating roof 502 such that the fluid level 94 remains the same in the recessed area 544 as the area between the inner wall 558 of the tank 500 and the side 503 of the floating roof 502. The equalization passageways 548 ensure that no volatile gas builds up in the recessed area 544.

Figure 10:
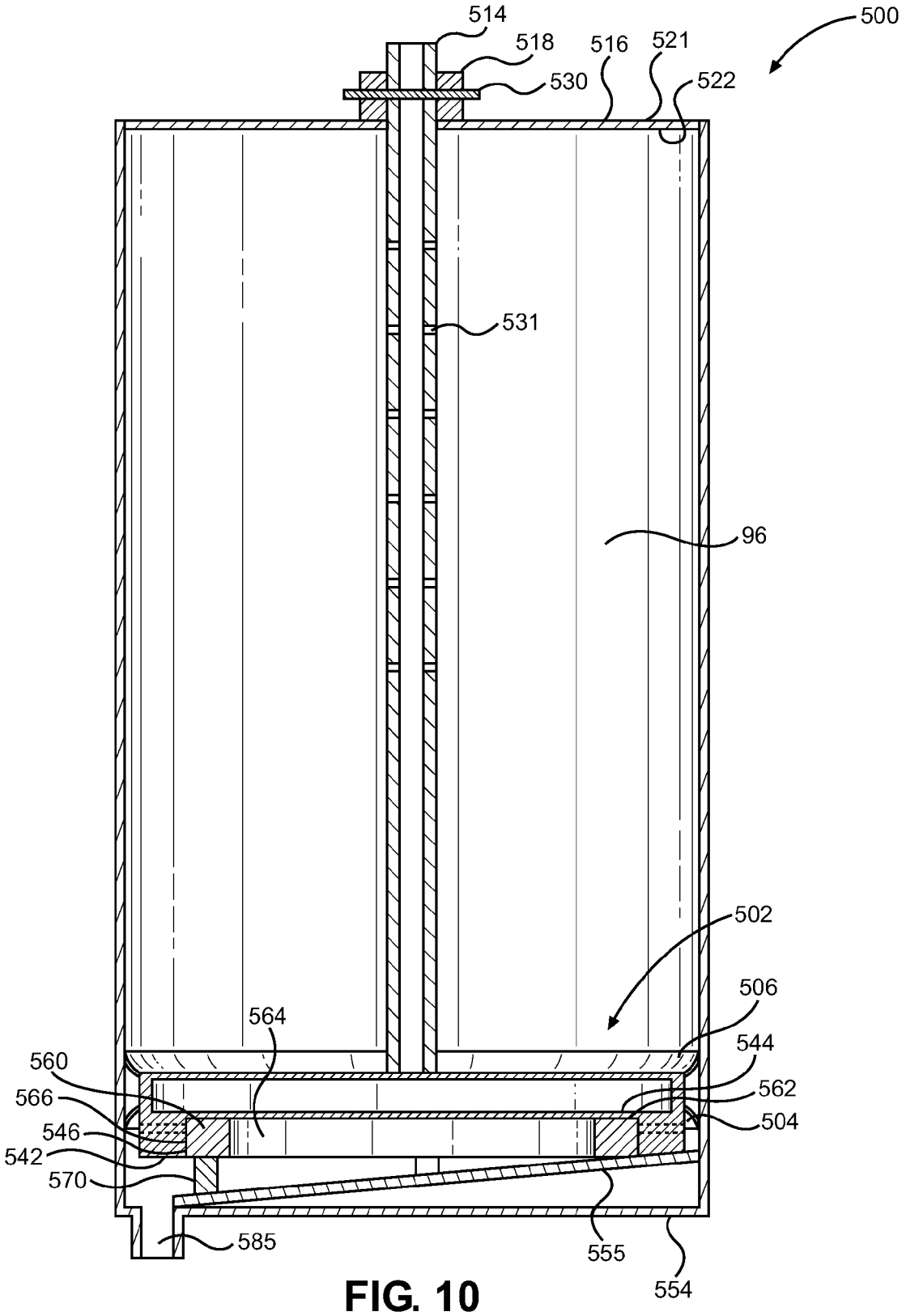
FIG. 10 is a cross-section view of a slant bottom tank of FIG. 9 with a support base ring and drained of liquid showing the floating roof resting on the support base ring with base ring supports of various heights to ensure that the support base ring is level with respect to the floating roof.

As can be seen in FIG. 10, liquid 92 is shown drained from the tank 500 such that the recessed area 544 of the floating roof 502 is resting on the base ring top 562 and the contact support surface 546 is located immediately adjacent to the outer surface 566 of the base ring 560. A pin 530 is slidably inserted through upper guide collar 518 and through a pin hole 531 in the upper guide 514 so as to lock the floating roof 502 to the base ring 560. Once so locked, the floating roof tank 500 is ready to be moved from a vertical position to a horizontal position for transport. As the tank 500 is moved from the vertical position to the horizontal position, the weight of the floating roof 502 will be transferred from the contact support surface 546 to the base ring outer surface 566. With the weight of the floating roof 502 being supported by the base ring outer surface 566, the weight of the floating roof 502 will not act on the primary seal 504 or the secondary seal 506, thus preserving the structural integrity of the seals 504 and 506 so that the tank may be transported in a horizontal position.

Figure 11:
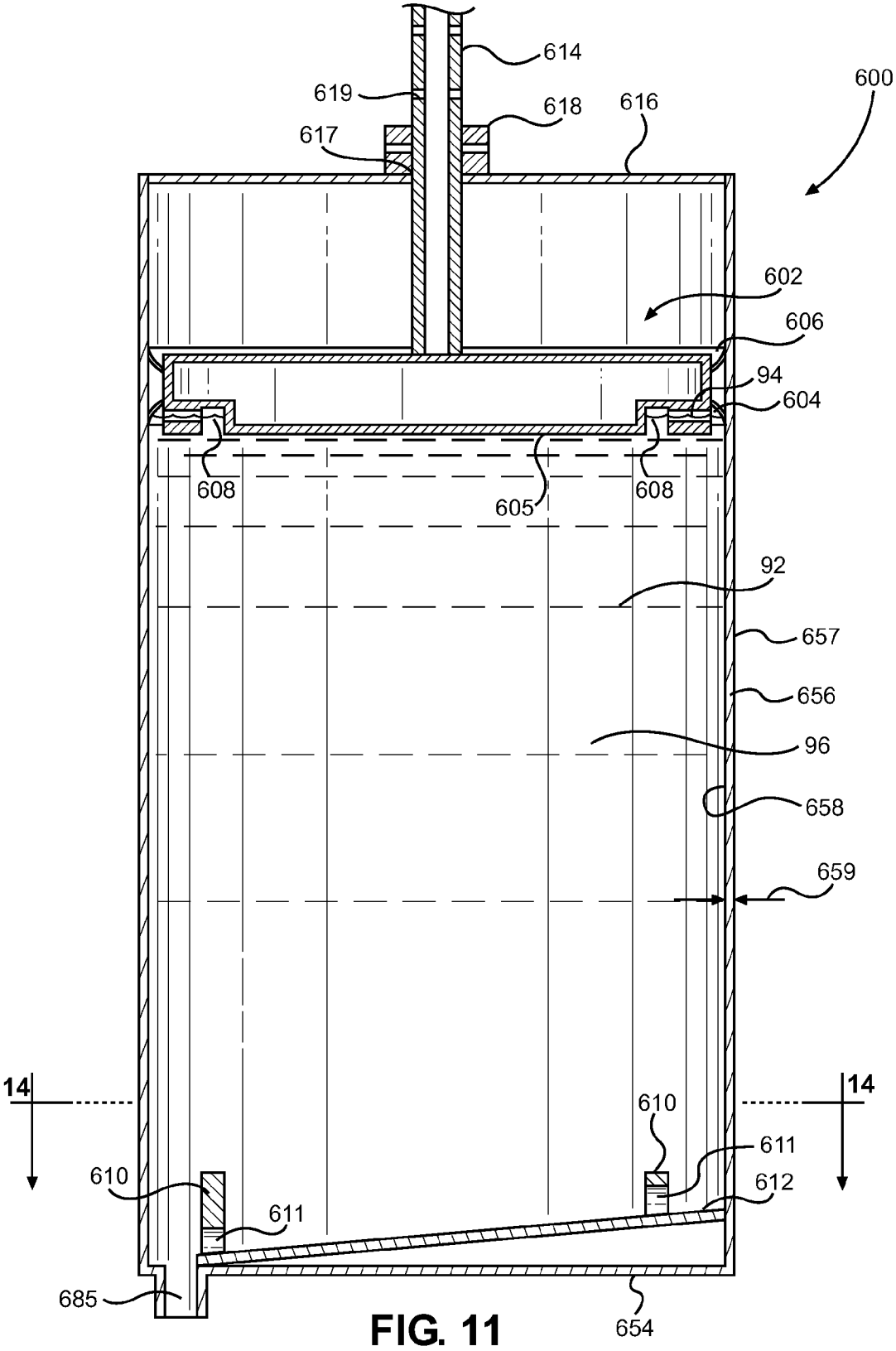
FIG. 11 is a cross-sectional view of an alternative embodiment of a slant bottom tank of the present invention with floating roof guide channels recessed in the bottom of the floating roof with corresponding sleeves mounted to the base of the tank.

FIG. 11 is a cross-sectional view of an alternative embodiment of a slant bottom tank 600 with floating roof guide channels 608 recessed in the bottom 605 of the floating roof 602 with corresponding sleeves 610 mounted to the slanted floor 612 of the tank 600. In this particular embodiment, the floating roof guide channels 608 constitute a support receiver. This embodiment of the floating roof tank 600 comprises the floating roof 602 having the primary seal 604, the secondary seal 606 and guide channels 608. Sleeves 610, which are disposed on the slanted floor 612 of the tank, are sized to fit in the guide channels 608 of the floating roof 602. The sleeves 610 have drain passageways 611 to allow fluid 92 to pass past the sleeves 610 along to slanted floor 612 toward the drain 685. Floating roof 602 may also include a centrally attached upper guide 614 which may extend through the outer roof 616 of the tank 600. Upper guide 614 may reciprocate through collar 618. Upper guide 614 may comprise a plurality of pin holes 619 through which a pin 620 or other locking device may be inserted as a secondary locking mechanism for securing floating roof 602 in position.

Figure 12:
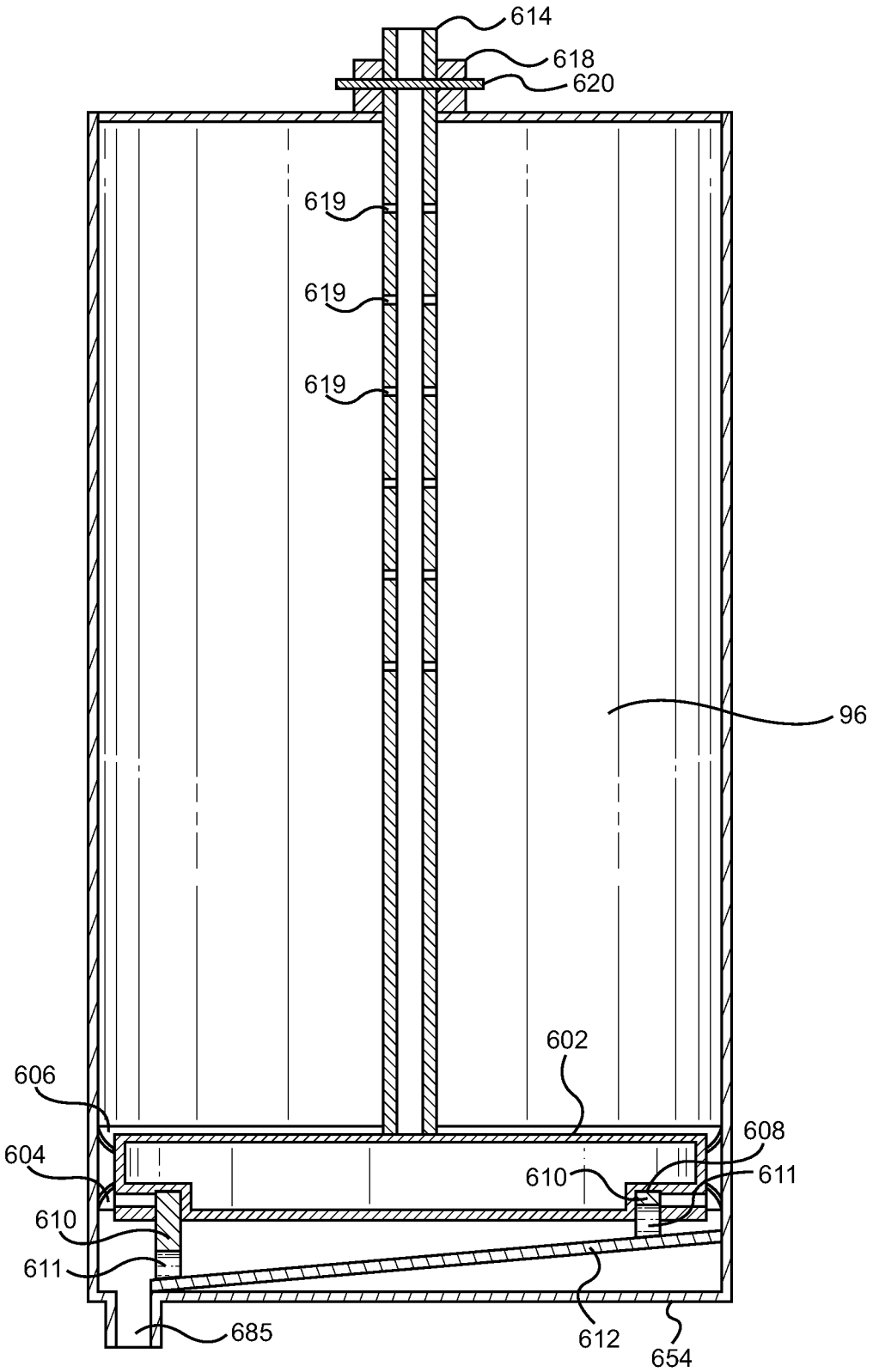
FIG. 12 is a cross-sectional view of the slant bottom floating roof tank of FIG. 11 drained of liquid with the floating roof guide channels securely placed on the corresponding sleeves mounted to the base of the tank and showing a pin through the upper guide thereby ensuring that the floating roof guide channels remain properly placed on the sleeves.

FIG. 12 is a cross-sectional view of a slant bottom floating roof tank 600 drained of a liquid 92 with the floating roof guide channels 608 securely placed on the corresponding sleeves 610 mounted to the slanted floor 612 of the tank 600 and showing a pin 630 through the upper guide 614 thereby ensuring that the floating roof guide channels 608 remain properly placed on the sleeves 610. When it is desired to move tank 600 or to change it from a vertical to horizontal position, when the tank 600 is emptied, the floating roof 602 will drop to the lower section of the tank and guide channels 608 will land into sleeves 610, thereby securing the floating roof into position. Pin 620 may also be inserted within an pin hole 619 within upper guide 614. When thus secured, the tank 600 may be repositioned from a vertical to a horizontal orientation for either transport or storage.

Figure 13:
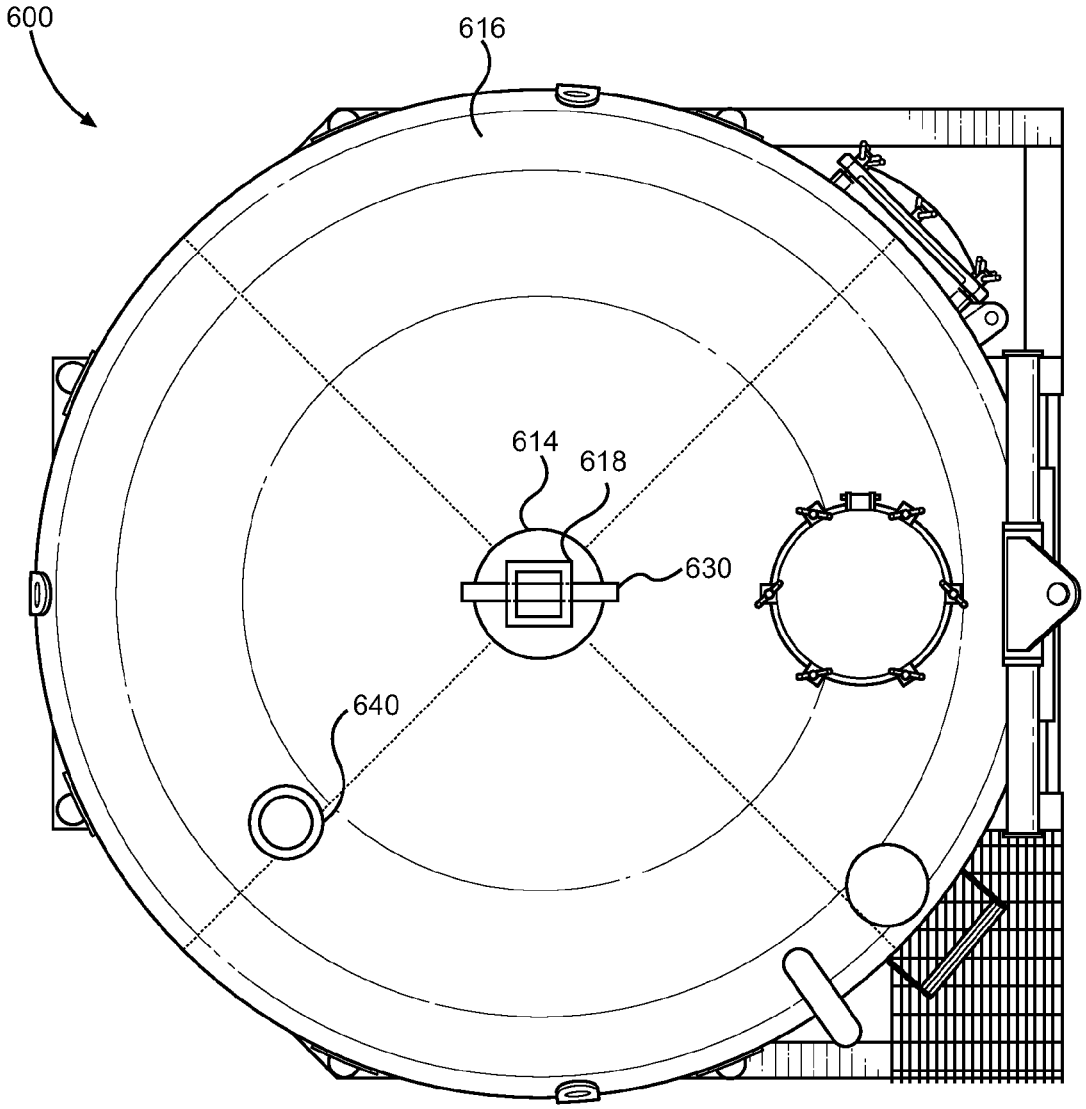
FIG. 13 is a top view of a tank equipped with a floating roof with sleeves and guides and showing a square guide to prevent rotation of the floating roof within the tank.

FIG. 13 is a top view of a tank 600 equipped with a floating roof 602 (not shown) with guide channels 608 that correspond to sleeves 610 secured to the tank slanted floor 612 and showing a square upper guide 618 passing through a hole 617 in the outer roof 616 and through square guide collar 614 mounted on the outer roof 616 in order to prevent rotation of the floating roof 602 within the tank 600. The square upper guide 618 ensures that the guide channels 608 always remain aligned with the sleeves 610 while the floating roof 602 moves as the liquid level changes.

Figure 14:
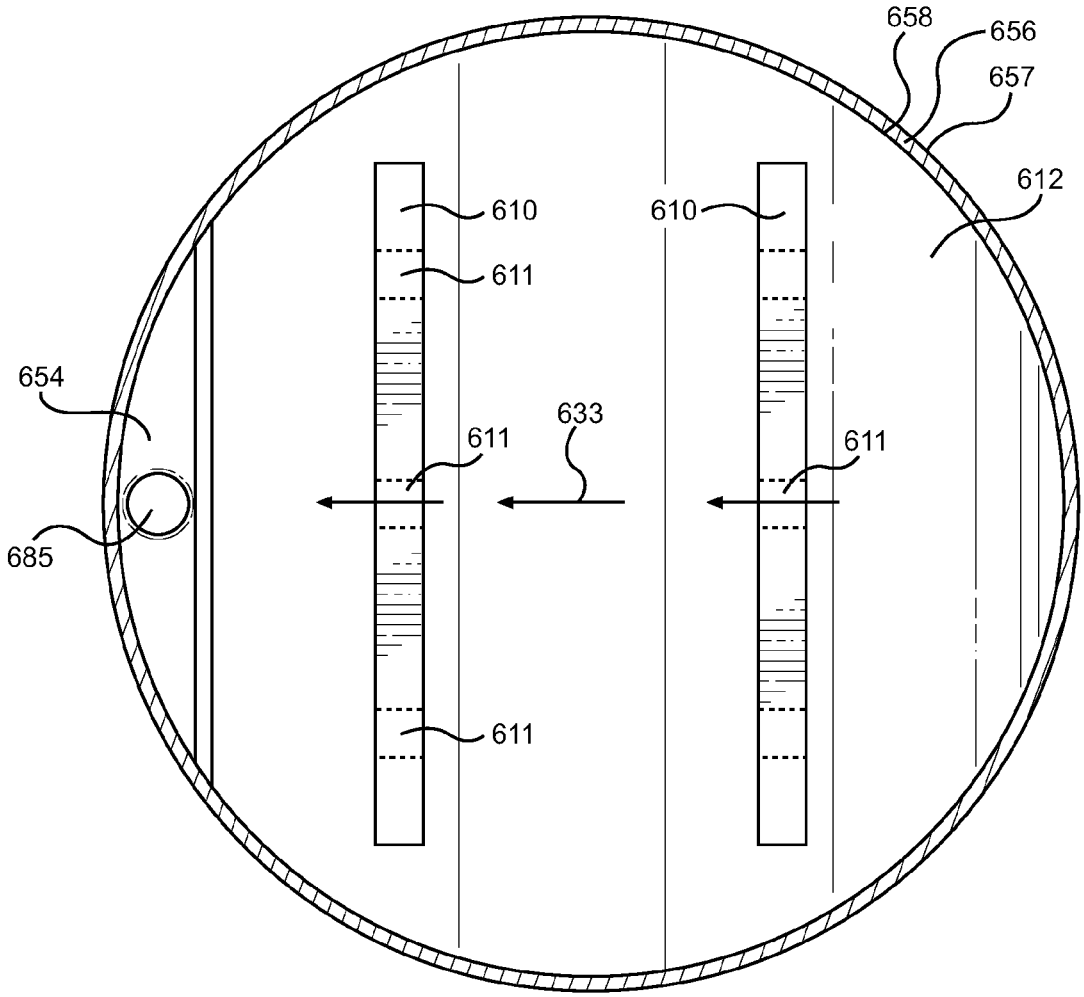
FIG. 14 is a cross-sectional view of the slant bottom floating roof tank of FIG. 11 taken along the lines 14-14 and showing the sleeves with drain passage ways along with the pathway of the liquid through the drain passage ways and into the drain.

FIG. 14 is a cross-sectional view of the slant bottom floating roof tank of FIGS. 11-13 taken along the lines 14-14 of FIG. 12 and showing the sleeves 610 with drain passage ways 611 along with the pathway 633 of the liquid 92 through the drain passage ways 611 and into the drain 685. The drain passage ways 611 ensure that liquid 92 can pass on the slanted floor 612 without being impeded by the sleeves 610.

Figure 15:
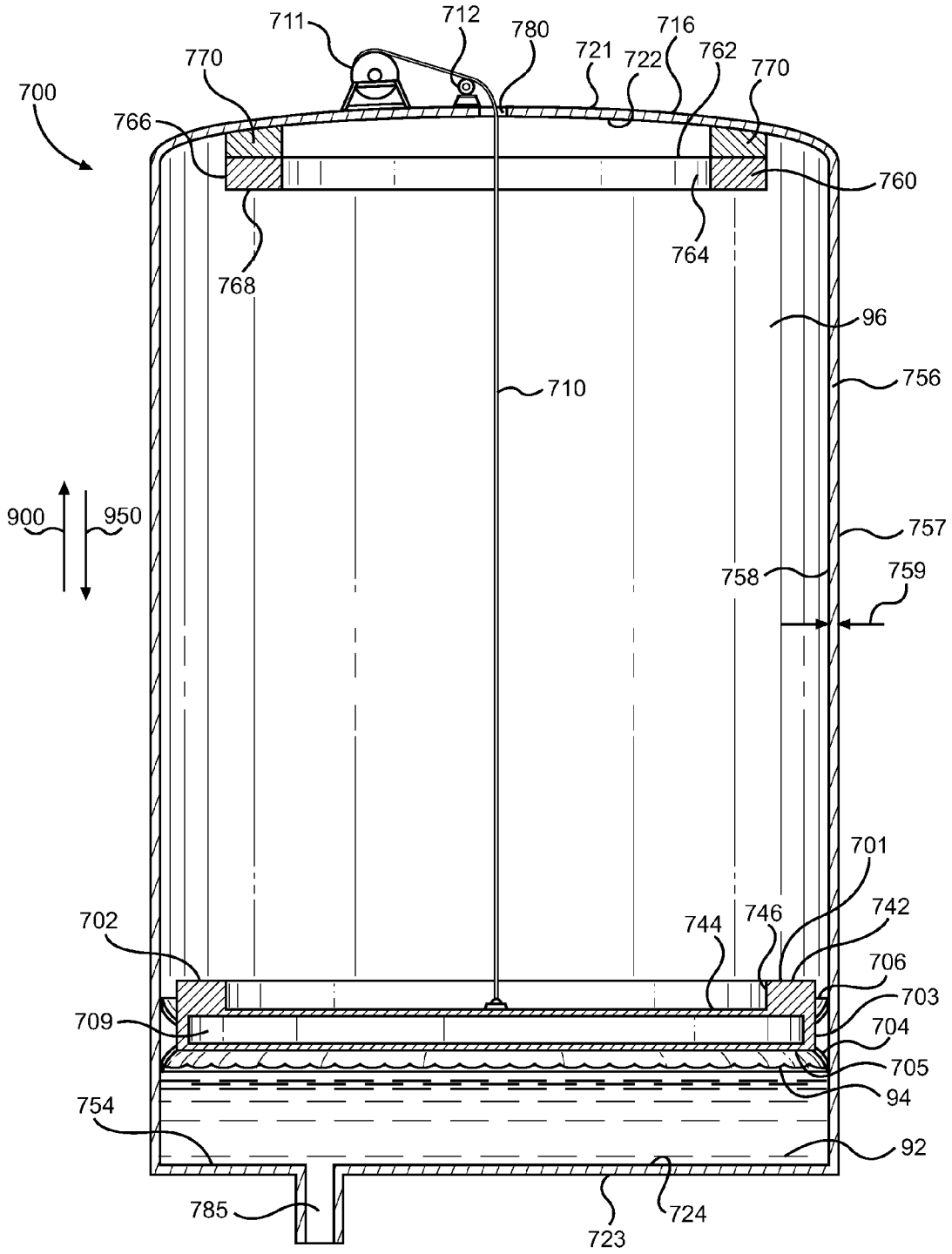
FIG. 15 is a cross-sectional view of an alternative embodiment of a flat bottom floating roof tank of the present invention with a support roof ring mounted to the outer roof of the floating roof tank with a winch cable passing through an opening in the outer roof and connected to the top of the floating roof such that the floating roof can be raised and lowered by the winch cable.

FIG. 15 is a cross-sectional view of an alternative embodiment of a cable tank 700 with a floating roof 702 and a support roof ring 760. The tank 700 has an outer roof 716, a bottom 754, a tank wall 756 and a drain 785. The tank wall 756 is made up of an outer surface 757 and an inner surface 758 with a thickness 759. The outer roof 716 has an outer roof exterior surface 721 and an outer roof interior surface 722.

The floating roof 702 has a top 701 and side 703 and a bottom 705. A primary seal 704 is connected to the side 703 of the floating roof 702. The primary seal 704 is in contact with the inner wall 758 of the tank wall 756 sufficiently to prevent vapors from the liquid 92 passing between the side 703 of the floating roof 702 and the inner wall 758 of the tank wall 756, yet maintain the ability to slide along the inner wall 758. A secondary seal 706 is also attached to the side 703 of the floating roof 702 and is also in contact with the inner wall 758. The floating roof 702 has a floating roof air chamber 709 that increases the buoyancy of the floating roof 702 such that the floating roof 702 will float on liquid 92 in the tank 700.

A winch cable 710 is connected to the top 701 of the floating roof 702. The winch cable 710 passes through an aperture 780 in the outer roof 716 of the tank 700 and is connected to a winch 711 mounted to the exterior surface 721 of the outer roof 716 of the tank 700. The winch cable 710 is directed through the aperture 780 by pulley 712.

The support roof ring 760 has a top 762, an inner surface 764 and outer surface 766 and a bottom 768. The bottom 768 of support roof ring 760 is mounted to support roof ring supports 770. The roof ring supports 770 are connected to the outer roof 716. The floating roof 702 is equipped with a support receiver comprised of an extended area 742 and a recessed area 744. The extended area 742 has a contact support surface 746 sized so as to ensure that the contact support surface 746 will rest against the outer surface 766 of the roof ring 760 when the tank 700 is moved from a vertical position to a horizontal position.

As seen in FIG. 15, the floating roof 702 is shown floating on liquid 92 at liquid level 94. As liquid 92 is added to the tank 700, the liquid level 94 increases causing the floating roof 702 to move in an upward direction 900. As liquid 92 is removed from the tank 700, the liquid level 94 decreases causing the floating roof 702 to move in a downward direction 950. When the tank 700 has no remaining liquid 92, the cable 710 holds the floating roof 702 just above the bottom 754 of the tank 700 to ensure that weight of the floating roof 702 does not compress the primary seal 704 against the bottom 754 of the tank 700.

Figure 16:
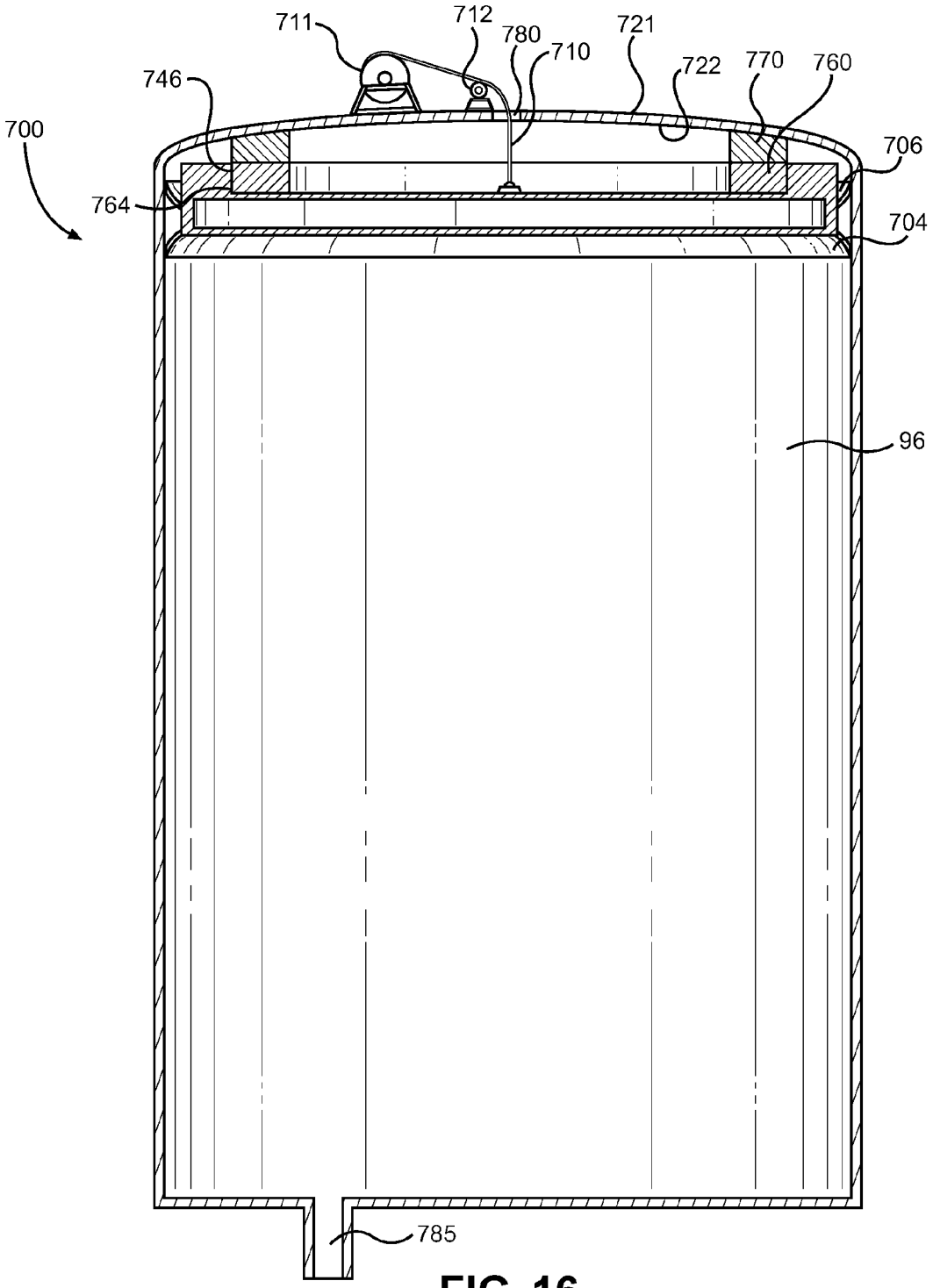
FIG. 16 is a cross-sectional view of the flat bottom floating roof tank of FIG. 15 with a support roof ring mounted to the outer roof with the winch cable securing the floating roof to the support roof ring.

As can be seen in FIG. 16, after the tank 700 has been drained of all liquid 92, the winch 711 winds the winch cable 710 such that the floating roof 702 moves in an upward direction 900 until the recessed area 744 of the floating roof 702 is resting on the roof ring top 762 and the contact support surface 746 is located immediately adjacent to the outer surface 766 of the roof ring 760. The winch 711 can then be locked so as to ensure that the floating roof 702 remains firmly secured on the roof ring 760. Once so locked, the tank 700 is ready to be moved from a vertical position to a horizontal position for transport. As the tank 700 is moved from the vertical position to the horizontal position, the weight of the floating roof 702 will be transferred from the contact support surface 746 to the roof ring outer surface 766. With the weight of the floating roof 702 being supported by the roof ring outer surface 766, the weight of the floating roof 702 will not act on the primary seal 704 or the secondary seal 706, thus preserving the structural integrity of the seals 704 and 706 so that the tank may be transported in a horizontal position.

A variety of support receivers are disclosed herein and are contemplated by the present invention. Any support receiver that is sized to receive a corresponding support is contemplated by the present invention.

Figure 17:
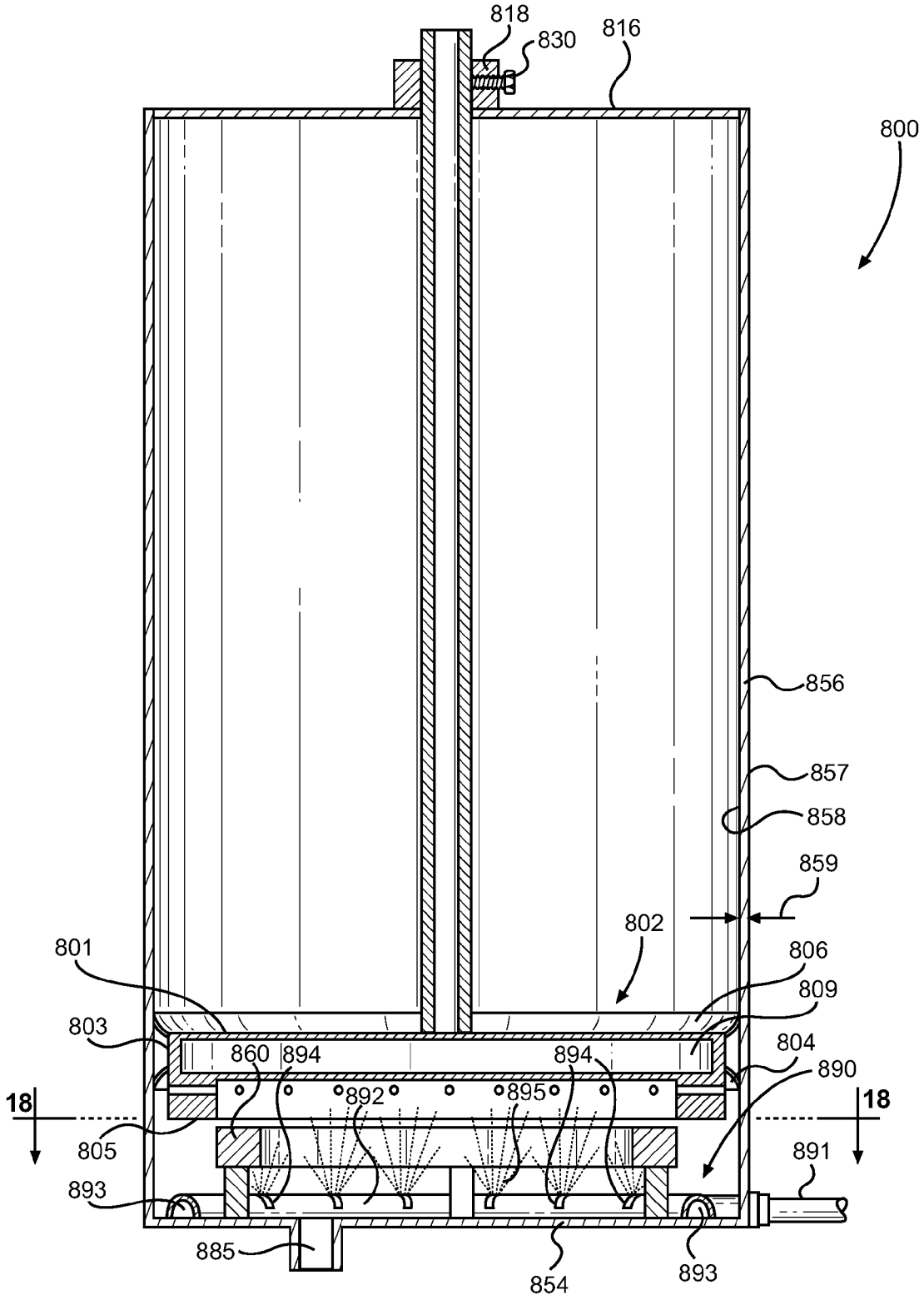
FIG. 17 is a cross-sectional view of an alternative embodiment of the flat bottom floating roof tank of the present invention with a base ring support mounted to the base of the tank and also equipped with a cleaning system where a cleaning liquid is circulated through a cleaning half pipe with a plurality of spray outlets that spray the cleaning liquid on the bottom surface of the floating roof.

FIG. 17 is a cross-sectional view of the self-cleaning floating roof tank 800 with a floating roof 802 and a support base ring 860. The self-cleaning floating roof tank 800 is equipped with a cleaning system 890. The tank 800 has an outer roof 816, a bottom 854, a tank wall 856 and a drain 885. The tank wall 856 is made up of an outer wall 857 and an inner wall 858 with a thickness 859. The floating roof 802 has a top 801, side 803 and bottom 805. A primary seal 804 is connected to the side 803 of the floating roof 802. The primary seal 804 is in contact with the inner wall 858 of the tank wall 856 sufficiently to prevent vapors from the liquid 92 (not shown in this Figure) passing between the side 803 of the floating roof 802 and the inner wall 858 of the tank wall 856, yet maintain the ability to slide along the inner wall 858. A secondary seal 806 is also attached to the side 803 of the floating roof 802 and is also in contact with the inner wall 858. The floating roof 802 has a floating roof air chamber 809 that increases the buoyancy of the floating roof 802 such that the floating roof 802 will float on liquid 92 in the tank 800. The floating roof 802 is equipped with an upper roof guide 814 that passes through an aperture in the outer roof 816 and an upper guide collar 818. To lock the floating roof 802 in place, a threaded locking nut 830 pass through the upper guide collar 818 an against the upper roof guide 814.

The cleaning system 890 includes an inlet 891 which passes through the tank wall 856 and into an annular cleaning pipe 892. In an embodiment, the annular cleaning pipe 892 is a half-pipe mounted to the bottom 854 of the tank 800 with a liquid passageway 893. The annular cleaning pipe 892 has a plurality of spray outlets 894 that are in fluid connection with the liquid passageway 893 and face the bottom 805 of the floating roof 802. Cleaning liquid 895 is introduced in the cleaning system 890 by way of the inlet 891. The cleaning liquid 895 can be introduced into the inlet 891 by a variety of means, not shown, such as a high pressure pump. The pressurized cleaning liquid 895 passes through the liquid passageway 893 of the annular cleaning pipe 892 such that cleaning liquid 895 is sprayed out of the spray outlets 894 into the interior of the tank 800 to facilitate the cleaning of the same. The cleaning liquid 895 and any waste particulates then pass through the drain 885.

Figure 18:
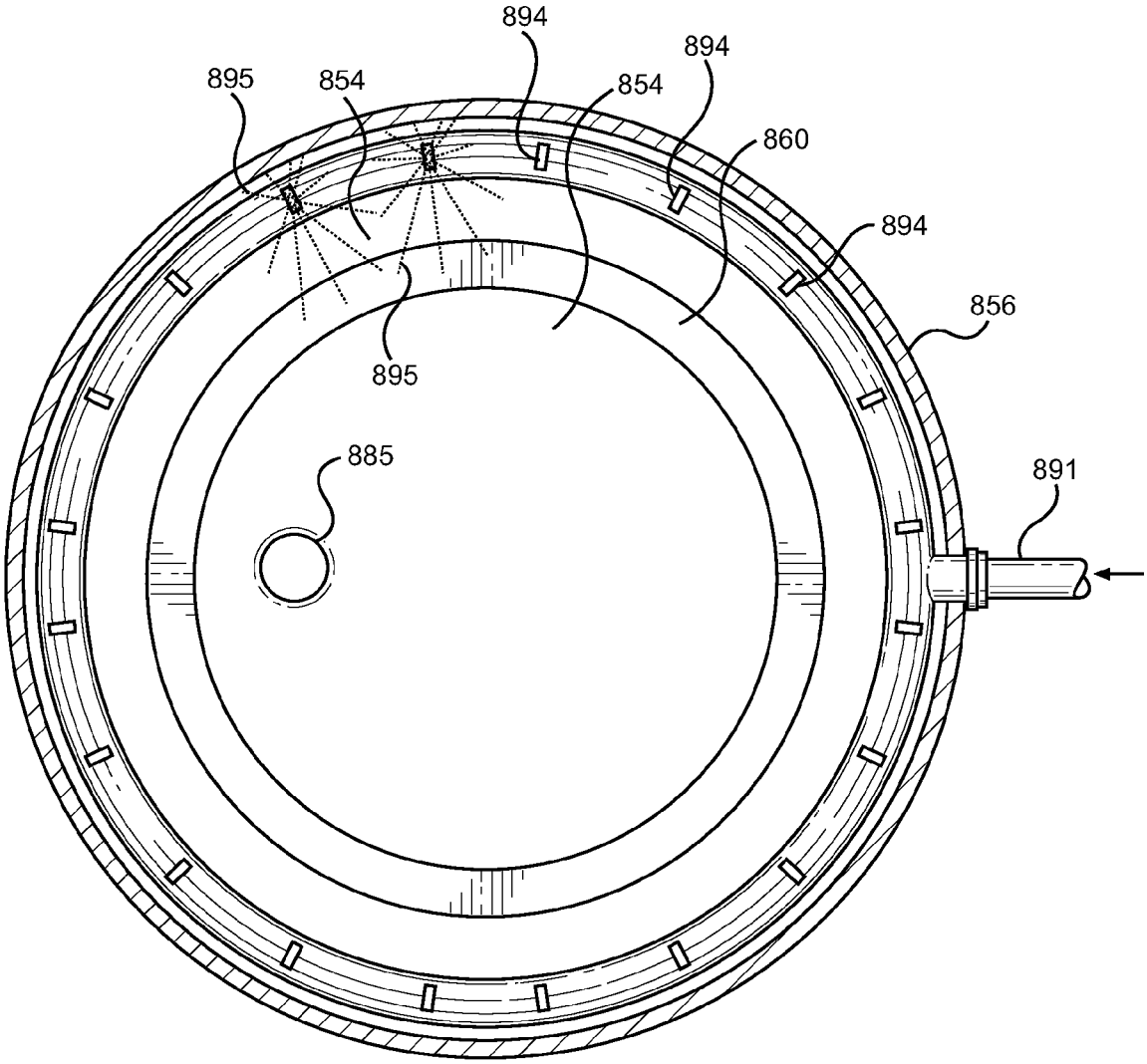
FIG. 18 is a cross-sectional view of the flat bottom floating roof tank of FIG. 17 taken along the lines 18-18, and showing the cleaning liquid inlet connected to a cleaning half pipe along with a plurality of spray outlets where the cleaning half pipe is circular and located between the tank wall and base ring support.

FIG. 18 is a cross-sectional view along the lines 18-18 as shown in FIG. 17, and showing the inlet 891 connected to an annular cleaning pipe 892 along with a plurality of spray outlets 894. In this particular embodiment, the annular cleaning pipe 892 is circular and located between the tank wall 856 and base ring 860.

Figure 19:
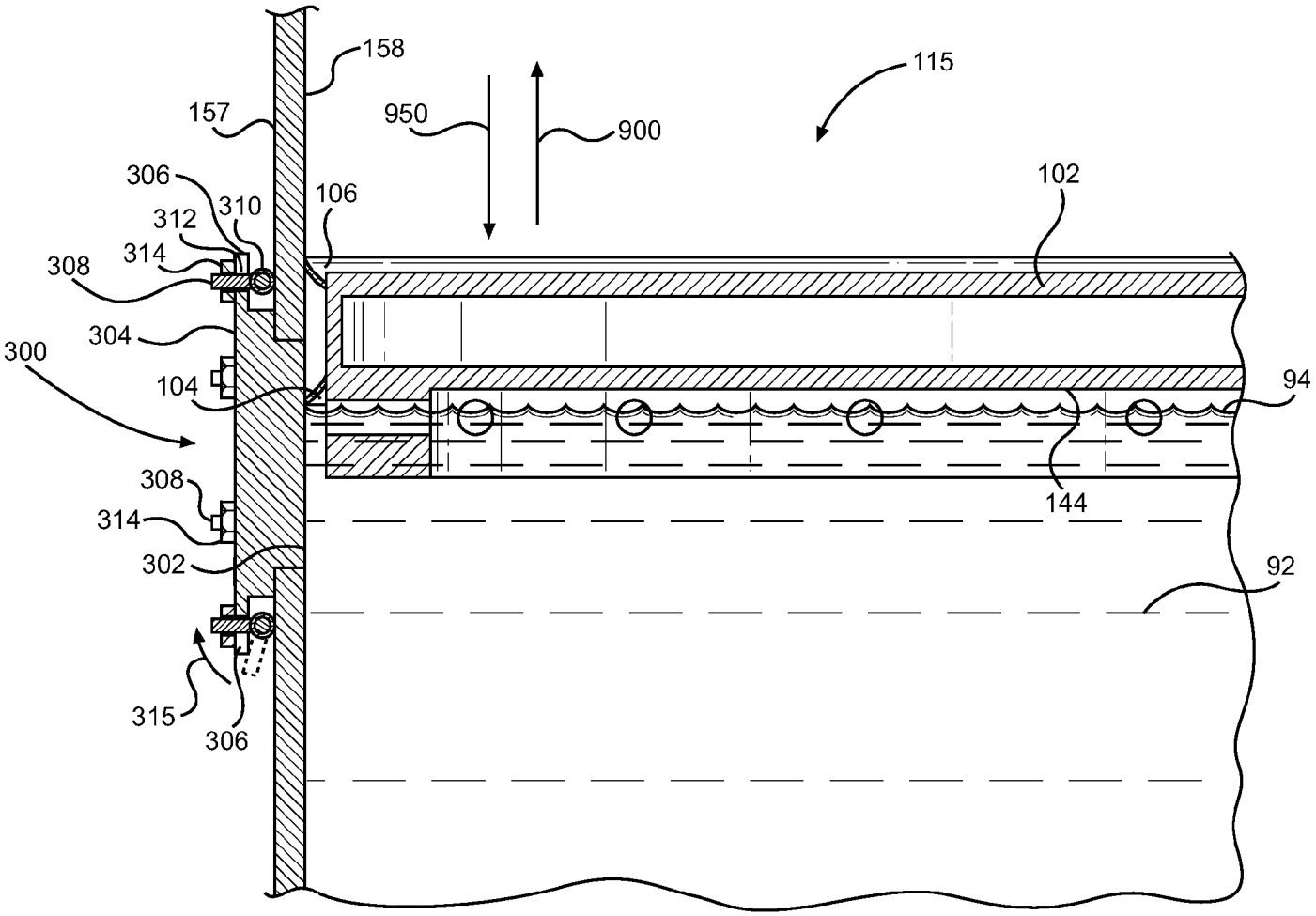
FIG. 19 is a detailed cross-sectional view of a floating roof tank equipped with a flush mounted manway cover where the interior wall of the manway cover is flush with the inner wall of the floating roof tank the seal between the inner wall of the tank and the side of the floating roof is maintained as the floating roof goes up and down.

FIG. 19 is a detailed cross-sectional view of the floating roof tank 150 shown in FIGS. 2 through 4 and also equipped with a flush mounted manway cover 300. The flush mounted manway cover 300 has an inner wall 302 and an outer wall 304. Around the perimeter of the outer wall 304 is a plurality of bolt slots 306. Fastener bolts 308 are rotatably attached to bolt housing 310, which in turn are connected to the outer wall 157 of the tank 150. When the manway cover 300 is closed, the fastener bolts 308 are rotated about their bolt housing 310 in direction 315 such that they pass through corresponding bolt slots 306. In an embodiment, the fastener bolts 308 are threaded to receive a locking nut 314 such that the locking nut 314 rests on the outer wall 304 over the blot slots 306 to securely fasten the manway cover 300 to the outer wall 157 of the tank 150.

When closed, the inner wall 302 is flush with the inner wall 158 of the tank 150 such that the primary and secondary seals 104 and 106 maintain a sufficient seal to prevent vapors from passing past either the primary or secondary seals 104 and 106 in the vapor free area 115. As the floating roof 102 moves in downward direction 900, the primary and secondary seals 104 and 106 remain sealed against the inner wall 302 of the manway cover 300. Similarly, as the floating roof 102 moves in upward direction 900, the primary and secondary seals 104 and 106 remain sealed against the inner wall 302 of the manway cover 300. It is to be appreciated that the flush mounted manway cover 300 can be used in any of the tanks set forth in this application, including cone bottom tanks 150, flat bottom tanks 450 and slant bottom tanks 550.

Figure 20:
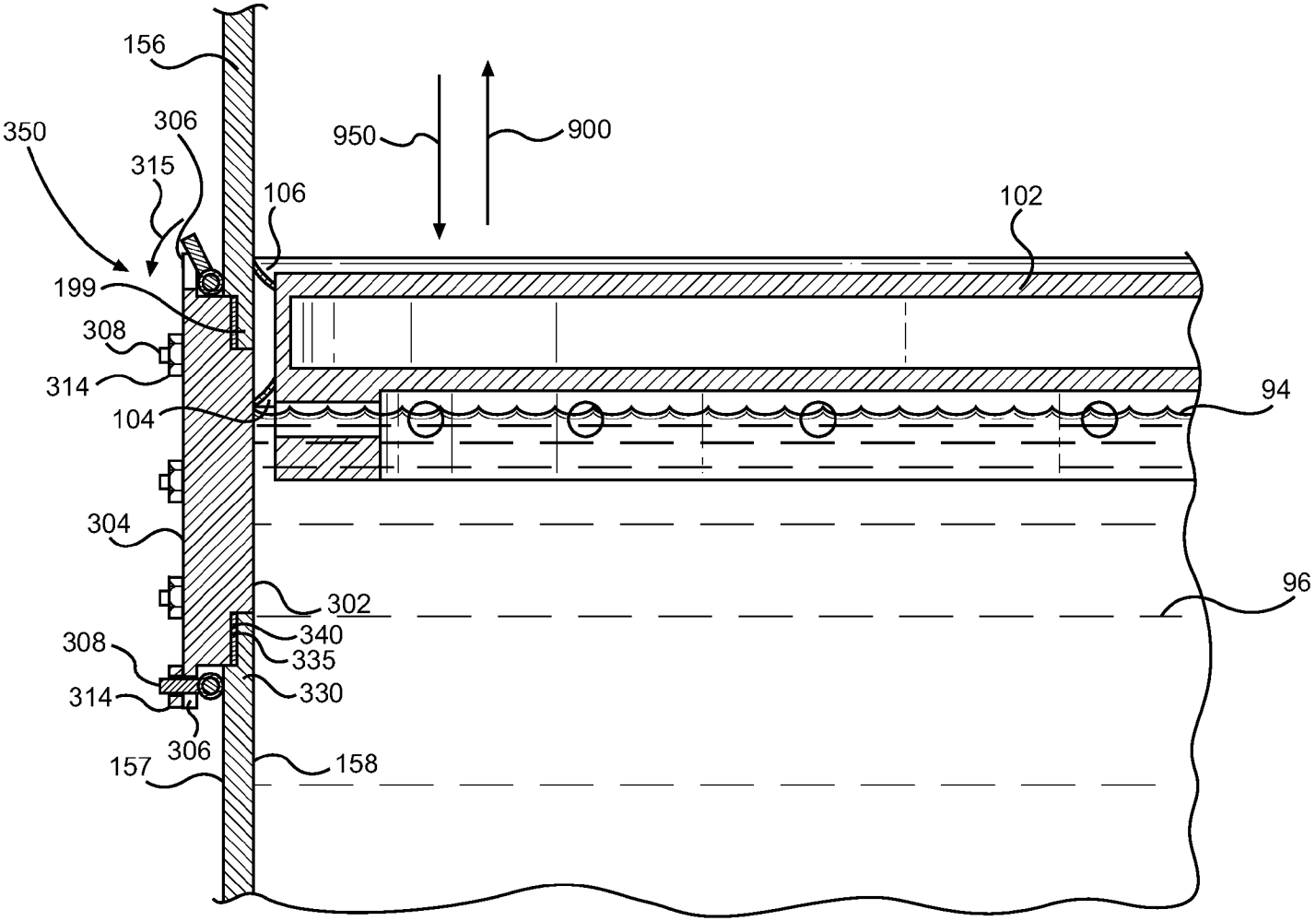
FIG. 20 is a detailed cross-sectional view of a floating roof tank equipped with an alternative flush mounted manway cover where the tank wall has a recessed area sized to receive a gasket and outer flange of the manway cover where the interior wall of the manway cover is flush with the inner wall of the floating roof tank to ensure that no air gap is created when the floating roof passes over the manway cover.

FIG. 20 is a detailed cross-sectional view of the floating roof tank 150 shown in FIGS. 2 through 4 and also equipped with an alternative flush mounted manway cover 350. In this embodiment, in addition to the inner wall 302 and the outer wall 304, the manway cover 350 has flange 340. The tank wall 156 of the tank 150 has a tank flange area 199 sized to receive flange 340 of the manway cover 350. A gasket 335 can be paced between the flange 340 and tank flange area 199 to ensure a more adequate seal of the manway cover 350 to the tank wall 156. When the manway cover 350 is closed, the fastener bolts 308 are rotated about their bolt housing 310 in direction 315 such that they pass through corresponding bolt slots 306. In an embodiment, the fastener bolts 308 are threaded to receive a locking nut 314 such that the locking nut 314 rests on the outer wall 304 over the blot slots 306 to securely fasten the manway cover 300 to the outer wall 157 of the tank 150.

Figure 21:
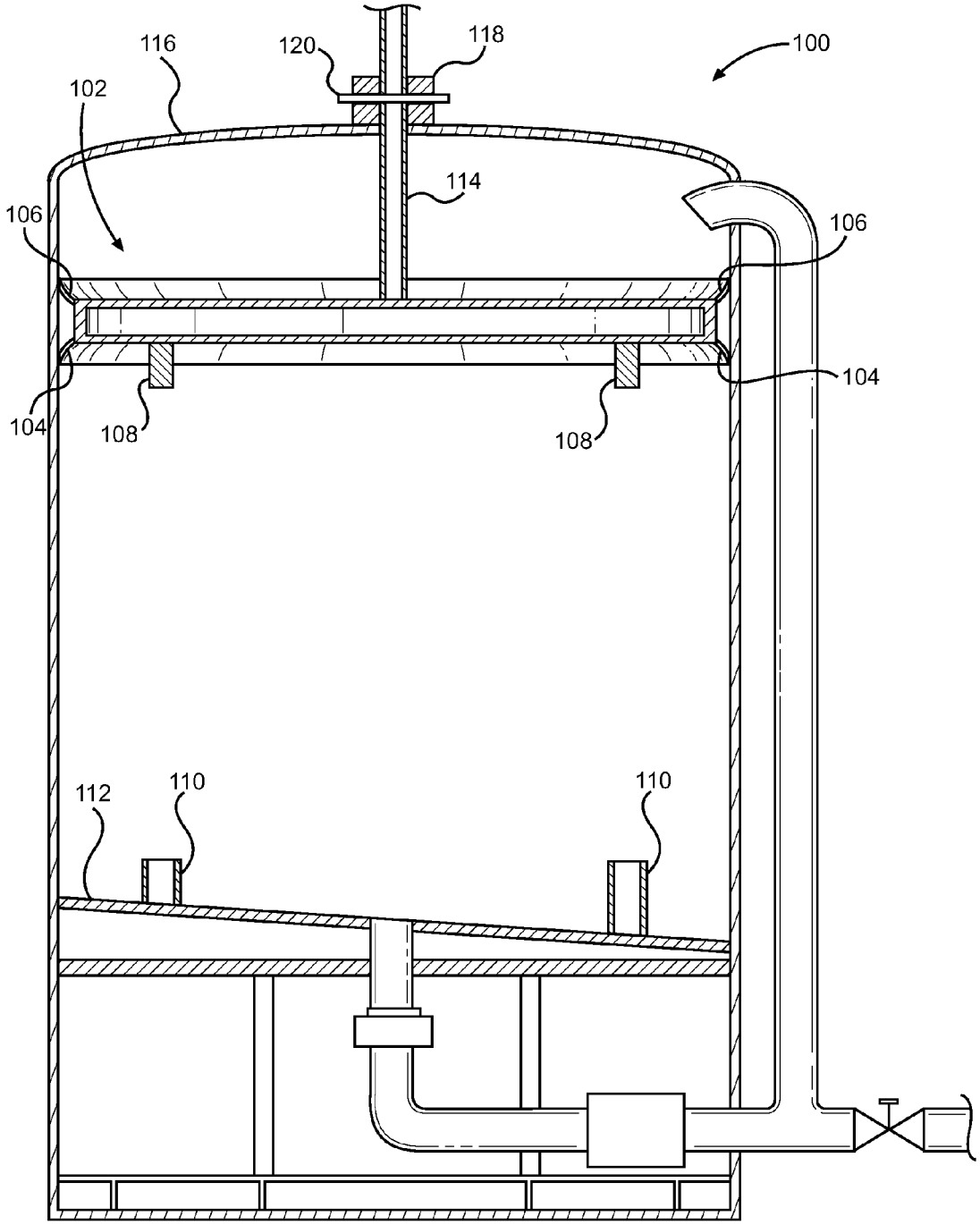
FIG. 21 shows a sectioned view of an alternate embodiment of a floating roof tank of the present invention, in the vertical position.

FIG. 21 shows, in sectioned view, an embodiment of a floating roof tank 100 of the present invention, with the tank in the vertical position. This embodiment of the floating roof tank 100 comprises the floating roof 102, the primary seals 104, the secondary seals 106, guides 108, and sleeves 110, which are disposed on the slanted floor 112 of the tank. Floating roof 102 may also comprise a centrally attached upper guide 114 which may extend through the outer roof 116 of the tank. Upper guide 114 may reciprocate through collar 118. Upper guide 114 may comprise a plurality of apertures through which a pin 120 or other locking device may be inserted as a secondary locking mechanism for securing floating roof 102 in position. When it is desired to move tank 100 or to change it from a vertical to horizontal position, when the tank 100 is emptied, the floating roof 102 will drop to the lower section of the tank and guides 108 will land into sleeves 110, thereby securing the floating roof into position. Pin 120 may also be inserted within an aperture within upper guide 114. When thus secured, the tank 100 may be repositioned from a vertical to a horizontal orientation for either transport or storage.

Figure 22:
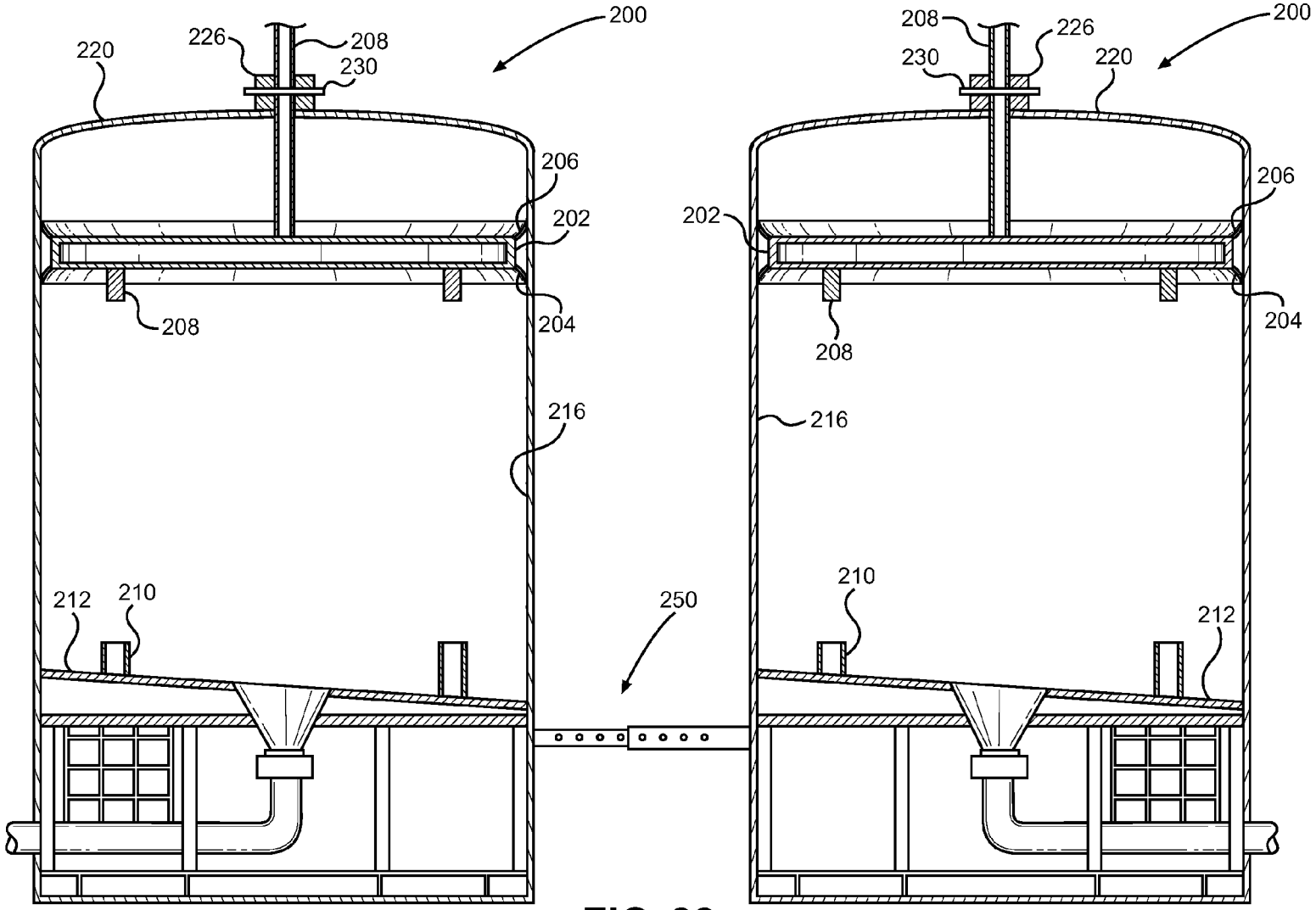
FIG. 22 shows a partially sectioned view of an embodiment in which two floating roof tanks of the present invention are connected together to increase the storage capacity, wherein the floating roof structures are near the top of the vessels.

FIG. 22 shows a partially sectioned view of two floating roof tanks 200 of the invention connected together with stabilizer bars 250. The floating roofs 202 of each tank are shown in FIG. 22 as being located near the enclosed top 220 of each vessel, with primary seals 204 and secondary seals 206 schematically indicated on the drawing. This embodiment may comprise axial members 208 which are connected to the floating roof 202 of each tank and which move up and down in concert with floating roof 202. It is to be appreciated that the axial members 208 may be of sufficient length for the floating roof 202 to land at the sloped bottoms 212 of the tanks 200. As shown in FIG. 3, this embodiment may comprise guides 208 which land into sleeves 210 when the tank 200 is empty. In addition or alternatively, axial members 208 may be locked in place by inserting a pin 230 through external sleeve 226, which is fixedly mounted to the exterior of the tank and through one of a plurality of holes axially positioned along axial member 208. Securing the pin 230 in this manner locks the position of floating roof with respect to the inside wall 216 of the tank.

Figure 23:
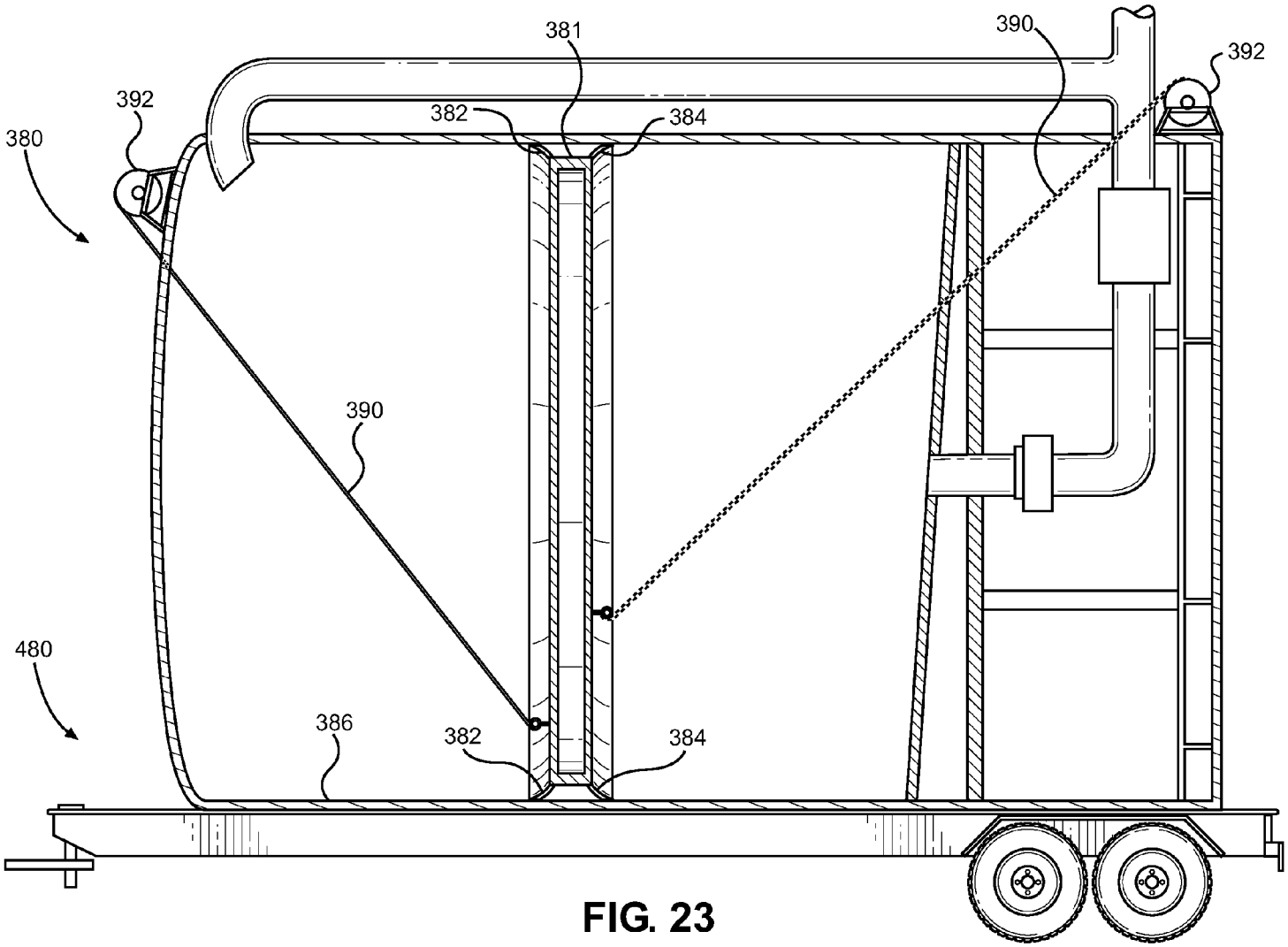
FIG. 23 shows an alternate embodiment of the presently disclosed floating roof tank which has been placed in a horizontal position on a trailer.

FIG. 23 shows an embodiment of the floating roof tank 380 placed in a horizontal position on a trailer 480. In this embodiment, floating roof 381 has primary seals 382 and secondary seals 384. In this embodiment, the position of floating roof 381 may be locked in position with respect to inside wall 386 by one or more cables 390 which are controlled by winches 392.

As can be seen by the various embodiments discussed above, the important structural features of the present invention include those which lock the position of the floating roof with respect to the inside wall of the tank. This feature is independent upon the different seal configurations, or the other different devices utilized to maintain the integrity or effectiveness of the seal. While the above is a description of various embodiments of the present invention, further modifications may be employed without departing from the spirit and scope of the present invention. Thus the scope of the invention should not be limited according to these factors, but according to the following claims.

What is claimed is:

1. A floating roof tank comprising:

a tank having a bottom, a tank wall having an interior surface, and an outer roof, said bottom, said tank wall, and said outer roof together forming a tank interior space capable of storing a fluid within said tank interior space;

a floating roof with a top, a bottom, and a side, and formed with at least one support receiver wherein said floating roof floats on said fluid within said tank when said tank is in a vertical position;

a primary seal extending between said floating roof and said interior surface of said tank wall and establishing a seal therebetween; and a support mounted to said tank within said interior space and configured to receive said support receiver of said floating roof when said tank interior space is emptied of said fluid and wherein said support holds said floating roof when said tank is moved from said vertical position to a horizontal position.

2. The floating roof tank of claim 1, further comprising:

said support receiver of said floating roof having a recess formed on said bottom of said floating roof; and said support sized to be closely received within said recess.

3. The floating roof tank of claim 2, wherein said support is a support base ring.

4. The floating roof tank of claim 3 wherein said support base ring is mounted to said bottom of said tank.

5. The floating roof tank of claim 3, wherein said support base ring is mounted to said tank wall.

6. The floating roof tank of claim 2, wherein said support is a support sleeve.

7. The floating roof tank of claim 6 wherein said support sleeve is mounted to said bottom of said tank.

8. The floating roof tank of claim 6, wherein said support sleeve is mounted to said tank wall.

9. The floating roof tank of claim 1, further comprising:

said support receiver of said floating roof having a recess formed on said top of said floating roof; and said support sized to be closely received within said recess.

10. The floating roof tank of claim 9, wherein said support is a support base ring.

11. The floating roof tank of claim 10 wherein said support base ring is mounted to said outer roof of said tank.

12. The floating roof tank of claim 10, wherein said support base ring is mounted to said tank wall.

13. The floating roof tank of claim 9, wherein said support is a support sleeve.

14. The floating roof tank of claim 13 wherein said support sleeve is mounted to said top of said tank.

15. The floating roof tank of claim 13, wherein said support sleeve is mounted to said tank wall.

16. The floating roof tank of claim 1, further comprising a cleaning system with a cleaning pipe mounted to said bottom of said tank and having an inlet and at least one spray outlet within said interior space.

17. The floating roof tank of claim 1, further comprising:

an aperture formed in said outer roof;

an upper guide collar connected to the outer surface about said aperture; and an upper guide extending from said floating roof and passing through said aperture and said collar.

18. The floating roof tank of claim 17, further comprising a means for fastening said upper guide to said upper guide collar.

19. The floating roof tank of claim 1, further comprising:

an aperture formed in said outer roof;

a winch adjacent said aperture and having a cable passing through said aperture and attached to said floating roof configured to raise and lower said floating roof within said tank interior space.

20. The floating roof tank of claim further comprising a manway cover configurable from an open position to a closed position wherein said inner surface of said manway cover is flush with said interior surface of said tank wall.

* * * * *

UNITED STATES PATENT AND TRADEMARK OFFICE

CERTIFICATE OF CORRECTION

PATENT NO. : 9,359,131 B2
APPLICATION NO. : 14/282799
DATED : June 7, 2016
INVENTOR(S) : Stanley W. Ellis It is certified that error appears in the above-identified patent and that said Letters Patent is hereby corrected as shown below:

In the Claims

Column 16, line 28, change "claim" to -claim 1-

Signed and Sealed this
Second Day of August, 2016

Michelle K. Lee

Michelle K. Lee
*Director of the United States Patent and Trademark Office*